US010448705B2

(12) United States Patent
Inomata et al.

(10) Patent No.: US 10,448,705 B2
(45) Date of Patent: Oct. 22, 2019

(54) SHOE SOLE WITH IMPROVED GRIP CAPACITY

(71) Applicant: ASICS Corporation, Kobe-shi (JP)

(72) Inventors: Takashi Inomata, Kobe (JP); Kenta Moriyasu, Kobe (JP); Shuhei Takemura, Kobe (JP); Yasuyuki Takada, Kobe (JP); Yousuke Atarashi, Kobe (JP); Fumitaka Kamifukumoto, Kobe (JP)

(73) Assignee: ASICS CORPORATION (JP)

( * ) Notice: Subject to any disclaimer, the term of this patent is extended or adjusted under 35 U.S.C. 154(b) by 113 days.

(21) Appl. No.: 15/554,677

(22) PCT Filed: Mar. 23, 2015

(86) PCT No.: PCT/JP2015/058721
§ 371 (c)(1),
(2) Date: Sep. 5, 2017

(87) PCT Pub. No.: WO2016/151727
PCT Pub. Date: Sep. 29, 2016

(65) Prior Publication Data
US 2018/0035754 A1 Feb. 8, 2018

(51) Int. Cl.
*A43B 13/22* (2006.01)
*A43B 13/14* (2006.01)
(Continued)

(52) U.S. Cl.
CPC ..... *A43B 13/223* (2013.01); *A43B 5/002* (2013.01); *A43B 5/06* (2013.01); *A43B 13/04* (2013.01);
(Continued)

(58) Field of Classification Search
CPC ... A43B 13/223; A43B 13/122; A43B 13/125; A43B 13/14; A43B 5/002; A43B 5/06
See application file for complete search history.

(56) References Cited

U.S. PATENT DOCUMENTS 2,408,214 A * 9/1946 Husted ..... A43B 13/223 36/59 C
D185,462 S * 6/1959 Ratner ..... 36/59 C
(Continued)

FOREIGN PATENT DOCUMENTS

EP 0 383 489 A1 8/1990
EP 2 984 959 A1 2/2016
(Continued)

OTHER PUBLICATIONS

Extended European Search Report for European Patent Application No. 15886282.1 dated Feb. 13, 2019.
(Continued)

*Primary Examiner* — Ted Kavanaugh
(74) *Attorney, Agent, or Firm* — Katten Muchin Rosenman LLP

(57) ABSTRACT

A plurality of rubber-made medial cleats project from a base surface of an outsole in a medial portion of a forefoot portion, and a plurality of rubber-made lateral cleats project from the base surface of the outsole in a lateral portion of the forefoot portion, wherein a first engaging surface of each of the medial cleats faces toward a posterior direction or an obliquely posterior direction and a second engaging surface of each of the lateral cleats faces toward an anterior direction or an obliquely anterior direction.

20 Claims, 14 Drawing Sheets

(51) Int. Cl.

| | |
|---|---|
| ***A43B 5/00*** | (2006.01) |
| ***A43B 5/06*** | (2006.01) |
| ***A43B 13/04*** | (2006.01) |
| ***A43B 13/12*** | (2006.01) |

(52) U.S. Cl.
CPC ..... *A43B 13/122* (2013.01); *A43B 13/125* (2013.01); *A43B 13/14* (2013.01); *A43B 13/141* (2013.01)

(56) References Cited

U.S. PATENT DOCUMENTS

| | | | | | |
|---|---|---|---|---|---|
| 2,981,011 | A * | 4/1961 | Pietro | A43B 13/223 | 36/28 |
| 3,006,085 | A * | 10/1961 | Bingham, Jr. | A43B 13/223 | 36/59 C |
| 3,507,059 | A * | 4/1970 | Vietas | A43B 13/223 | 36/32 R |
| 4,327,503 | A * | 5/1982 | Johnson | A43B 13/223 | 36/129 |
| 4,404,759 | A * | 9/1983 | Dassler | A43B 5/06 | 36/129 |
| 4,747,220 | A | 5/1988 | Autry et al. | | |
| 4,989,349 | A | 2/1991 | Ellis, III | | |
| 2006/0059716 | A1* | 3/2006 | Yamashita | A43B 13/14 | 36/59 R |
| 2007/0266597 | A1 | 11/2007 | Jones | | |
| 2012/0023781 | A1* | 2/2012 | Dojan | A43B 13/122 | 36/103 |
| 2012/0110876 | A1 | 5/2012 | Lubart | | |
| 2013/0333247 | A1* | 12/2013 | Grott | A43B 5/001 | 36/127 |
| 2015/0047231 | A1 | 2/2015 | Bunnell et al. | | |
| 2015/0351492 | A1* | 12/2015 | Dombrow | A43B 13/122 | 36/102 |

FOREIGN PATENT DOCUMENTS

| | | | |
|---|---|---|---|
| FR | 1 434 840 | A | 4/1966 |
| GB | 962 676 | A | 7/1964 |
| JP | S63-64207 | U | 4/1988 |
| JP | 2000-70003 | A | 3/2000 |
| JP | 3138770 | B2 | 2/2001 |
| JP | 2005-40234 | A | 2/2005 |
| JP | 2012-101057 | A | 5/2012 |
| JP | 2013-126529 | A | 6/2013 |
| JP | 5307356 | B2 | 10/2013 |
| WO | 2008/102986 | A1 | 8/2008 |
| WO | 2014-167713 | A1 | 10/2014 |

OTHER PUBLICATIONS

International Search Report for international Application No. PCT/JP2015/058721 dated Jun. 23, 2015.

* cited by examiner

CL
D1
T 5
11
50
50
LE
14E
15
14
5F
11
CN
S2
L2
L
M
L1
15
14
S1
S14
11
S3
5S
LE
11E
D3
5S
14
S11
15
11
S3
24E
5M
21
25
24
21E
S2
5S
21
31E
24
31
34E
S1
34
M
S2
5R
31
35
L
S31
34
5S
S34
D2
S3
35
5S
S3
ME
LA

ME
D3
CL
LA
T 5
5F
D1
50
H
11
S
Δ
50
52
θ1
G1
TS
14E
B
G1
S1
S3
53
θ3
A
54
51
H
S11
15
S
S14
51
54
53
TS
11E
S3
S2
B
D
A
GS
G
θ1
14
52
D
L
CN
C
G1
θ1
11
GS
G
53
M
14E
C
54
S1
15
θ3
11E
S2
G1
D2
θ1
24
ME
21
LA

CL

D1
T
5
50
50
S
51
11
H
H
CN
14
51
M
S
L
11
15
14
5S
11E
14E
5S
11
14
D3
24E
21
24
21E
5S
21
24
31
34
M
34E
L
31
34
31E
D2
31
35
ME
LA

D1

CL
5F
O4
NL3
14E
E4
E3
11
14
11E
E1
E2
NL1
NL3
15
11
14
NL1
NL4
E3
11
E2
E4
14
E1
11E
CL
NL2
O2
D3
D2
ME
LA (a) $\beta 1 > \alpha 1$, $\alpha 1 < 90°$ (b) $\beta 1 > \alpha 1$, $\alpha 1 \fallingdotseq 90°$ (c) $\beta 1 > \alpha 1$, $\alpha 1 > 90°$

SHOE SOLE WITH IMPROVED GRIP CAPACITY

TECHNICAL FIELD

The present invention relates to shoe soles with improved grip capacity for walking shoes, rain shoes and shoes for daily use, as well as shoe soles suitable for uneven terrain road surfaces and wet sloped road surfaces such as those for trail running, mountain climbing and cross country.

BACKGROUND ART

Generally, in order to improve the grip capacity on uneven terrain road surfaces, it is effective to increase the amount of soil to be scraped off when cleats bite into and grip the road surface. Therefore, it is important to increase the projected area of the cleats on a plane that is orthogonal to the direction of the load on the cleats from the road surface when gripping the road surface. However, conventional techniques do not sufficiently take into consideration the direction of the load within the sole surface when running on a sloped road surface, particularly the direction of the load in the forefoot portion. Also, the importance of the medial edge and the lateral edge of the shoe sole contacting the ground is not sufficiently taken into consideration, and cleats have not been designed while sufficiently taking the grip capacity into consideration.

CITATION LIST

Patent Literature

First Patent Document: WO2014/167713A1 (Abstract)
Second Patent Document: JP63-64207A (FIG. 2)
Third Patent Document: JP3138770B2 (FIG. 13B)
Fourth Patent Document: JP5307356 (FIG. 5)
Fifth Patent Document: JP2005-40234A (Abstract)
Sixth Patent Document: JP2012-101057A (Abstract)
Seventh Patent Document: JP2013-126529A (Abstract)
Eighth Patent Document: JP2000-070003A (FIG. 2)

In trail running, muddy uneven terrain road surfaces, as well as uphill and downhill sloped road surfaces, gravel roads and rocky roads, account for the majority of the course. Among others, road surfaces such as downhill wet rocky roads and muddy roads are particularly slippery, and therefore the importance of the grip capacity is high. As a result of motion analyses and analyses of actual races, it is preferred to take the following factors (i) to (iii) into consideration for running on a sloped road surface.

(i) Studies have revealed characteristics, e.g., landing starts from the forefoot portion to the midfoot portion, with the toe being open toward the lateral side relative to the heel, i.e., open-stance landing (open-stance contact). Therefore, the positions and directions of the cleats are determined with respect to the in-plane load on the outsole during this open-stance landing.

(ii) In order to improve the grip property on wet road surfaces, the directions and heights of the cleats with respect to the slip direction have a significant influence.

(iii) In order to improve the grip capacity on muddy ground, the projected area of the engaging surfaces of the cleats have a significant influence.

When the outsole is formed from a rubber having a low hardness, the outsole easily deforms, thereby improving the grip capacity. However, the outer peripheral edge of the low-hardness outsole is likely to peel off due to the external force while running or walking, thereby lowering the durability.

Note that the study and disclosure of Ichikawa (the first patent document: WO2014/167713A1) are about walking (e.g., 4 km/h) on a sloped road surface, and Ichikawa discloses or suggests nothing about running (e.g., 10 km/h) on a sloped road surface.

It is therefore an object of the present invention to provide a shoe sole with desirable grip capacity not only on the ground or a paved road surface, but also on a sloped road surface, particularly an uneven terrain road surface.

Before describing the configuration of the present invention, the direction of the load within the sole surface when running on a sloped road surface will be described.

The present inventor studied the primary positions and directions of the in-plane load on the sole when running (10 km/h) on a sloped road surface having a slope angle of 10°. FIG. 10 and FIG. 11 schematically show positions and directions of the load. In FIG. 10 and FIG. 11, each of arrows F1 and F2 generally and schematically represents the position and the direction of the load acting while running uphill and running downhill, respectively.

FIGS. 10(*a*) and 11(*a*) and FIGS. 10(*f*) and 11(*f*) show open angles (foot progression angles) B1 and B2, respectively, between the running direction D and the longitudinal axis CL of an outsole 5.

Generally, when running on a flat ground with no or little slope, one will run while landing in straight-stance landing (straight-stance contact) with the small open angle B1 of FIG. 10(*a*). On a road surface with a large slope, however, one will obtain a great propelling or braking force when the open angle B2 is large as shown in FIG. 10(*f*). This will be understood from the fact that the open angle B2 increases immediately after the start of a sprint race or a speed skating race.

The designations from 10% to 90% in FIG. 10 and FIG. 11 each represent a percentage of time from landing to takeoff. FIGS. 10(*b*) to 10(*e*) and FIGS. 11(*b*) to 11(*e*) show loads F1 and F2, respectively, when running uphill and running downhill while landing in straight-stance landing with the small open angle B1. On the other hand, FIGS. 10(*g*) to 10(*j*) and FIGS. 11(*g*) to 11(*j*) show loads F1 and F2, respectively, when running uphill and running downhill while landing in open-stance landing.

As can be seen from the position of the point of application of the load F1 of FIG. 10, it can be seen that the load F1 occurs primarily in a medial portion M of a forefoot portion 5F of the sole during the latter half of landing when running uphill. It is speculated that the reason for this is that the hallux and the second toe of the forefoot are exerting a great propelling force (propulsion force) in the heel rise phase.

It can also be seen that with straight-stance landing of FIG. 10(*b*) to FIG. 10(*e*), the load F1 is likely to occur toward a posterior D2 direction along the longitudinal axis CL of the sole. On the other hand, it can be seen that with open-stance landing of FIG. 10(*g*) to FIG. 10(*j*), the load F1 occurs toward an obliquely posterior and lateral LA direction that is significantly inclined with respect to the longitudinal axis CL.

From the results of the uphill running test, it is speculated that it is advantageous for running uphill to provide engaging surfaces for pushing off the foot toward a posterior D2 direction and an obliquely posterior and lateral direction in the medial portion M of the forefoot portion 5F of the sole.

As can be seen from the position of the point of application of the load F2 of FIG. 11, it can be seen that the load F2 occurs primarily in a lateral portion L of the forefoot portion 5F of the sole during the first half of landing when running downhill. It is speculated that the reason for this is that there occurs a continuous propelling force due to the potential energy when running downhill, and the little toe and the fourth toe of the forefoot need to exert a braking force in order to prevent slippage.

It can also be seen that with straight-stance landing of FIG. 11(*b*) to FIG. 11(*e*), the load F2 occurs toward an anterior D1 direction that is slightly inclined with respect to the longitudinal axis CL of the sole. On the other hand, with open-stance landing of FIGS. 11(*g*) to 11(*j*), the load F2 occurs not only in an anterior D1 direction but also in an obliquely medial direction that is significantly inclined with respect to the longitudinal axis CL.

It can also be seen from a comparison between the load F2 of FIGS. 11(*c*) to 11(*e*) and that of FIGS. 11(*h*) to 11(*j*) that a greater braking force is exerted from open-stance landing than from straight-stance landing.

From the results of the running downhill test, it is speculated that it is advantageous for running downhill to provide engaging surfaces for producing a braking force toward an anterior D1 direction and the obliquely anterior and medial ME direction in the lateral portion L of the forefoot portion 5F of the sole.

In a first aspect of the present invention, a forefoot portion 5F of a rubber-made outsole 5 includes a medial portion M, a lateral portion L, and a central portion CN between the medial portion and the lateral portion;

a plurality of rubber-made medial cleats 11 projecting from a base surface 5S of the outsole 5 or the midsole 4 are provided in the medial portion M of the forefoot portion 5F;

a plurality of rubber-made lateral cleats 14 projecting from the base surface 5S of the outsole 5 or the midsole 4 are provided in the lateral portion L of the forefoot portion 5F;

the medial cleats 11 and the lateral cleats 14 are spaced apart from each other in a width direction D3 perpendicular to a longitudinal axis CL of the outsole 5;

the medial cleats 11 each include a first engaging surface 11E, and a first opposing surface S1 on an opposite side from the first engaging surface 11E;

the lateral cleats 14 each include a second engaging surface 14E, and a second opposing surface S2 on an opposite side from the second engaging surface 14E;

the first engaging surface HE satisfies at least one of requirements (a1) to (c1) below with respect to the first opposing surface S1:

(a1) a length LE of the first engaging surface HE in the width direction D3 is greater than a length L1 of the first opposing surface S1 in the width direction;

(b1) an angle α1 of the first engaging surface 11E with respect to the base surface 5S is closer to 90° than an angle β1 of the first opposing surface S1 with respect to the base surface 5S;

(c1) a projection length Δ by which each of the medial cleats projects in the width direction D3 from an outer peripheral edge 50 of the base surface 5S is greater in the first engaging surface 11E side than in the first opposing surface S1 side; and the second engaging surface 14E satisfies at least one of requirements (a2) to (c2) below with respect to the second opposing surface S2:

(a2) a length LE of the second engaging surface 14E in the width direction D3 is greater than a length L2 of the second opposing surface S2 in the width direction;

(b2) an angle α2 of the second engaging surface 14E with respect to the base surface 5S is closer to 90° than an angle β2 of the second opposing surface S2 with respect to the base surface 5S;

(c2) a projection length Δ by which each of the lateral cleats projects in the width direction D3 from the outer peripheral edge 50 of the base surface 5S is greater in the second engaging surface 14E side than in the second opposing surface S2 side, and wherein:

the first engaging surface 11E of each of the medial cleats 11 faces toward a posterior direction D2 or an obliquely posterior direction; and the second engaging surface 14E of each of the lateral cleats 14 faces toward an anterior direction D1 or an obliquely anterior direction.

The first engaging surface 11E that satisfies at least one of the requirements (a1) to (c1) can exert an engaging force (grip force) greater than that of the first opposing surface S1. The second engaging surface 14E that satisfies at least one of the requirements (a2) to (c2) can exert an engaging force (grip force) greater than that of the second opposing surface S2.

The first engaging surface 11E of each of the medial cleats 11 faces toward a posterior D2 direction or an obliquely posterior direction. Therefore, when running uphill with straight-stance landing or open-stance landing, a great propelling force will be obtained by kicking the road surface with the medial cleats 11 of the forefoot portion 5F.

The second engaging surface 14E of each of the lateral cleats 14 faces toward an anterior D1 direction or an obliquely anterior direction. Therefore, when running downhill with straight-stance landing or open-stance landing, the lateral cleats 14 of the forefoot portion 5F will exert a braking force against the road surface, thereby suppressing slippage.

In the present invention, the medial portion M, the lateral portion L and the central portion CN can be understood to mean the medial section, the lateral section and the central section, respectively, obtained by dividing the outsole 5 in three in the width direction D3. Note that the medial and lateral cleats may extend toward the central portion CN from the medial portion M and the lateral portion L, respectively, or may not extend up to the edge of the medial portion M and the lateral portion L.

In the present invention, the base surface 5S of the outsole 5 means the lower surface of the base portion of the outsole 5. In the present invention, when the base surface 5S of the outsole 5 is not well-defined or absent, cleats projection is determined by whether cleats are projecting or not from the base surface 5S of the midsole 4.

In the present invention, there is no particular limitation on the height of projection Hp of the cleats, but typically, it is preferably 1 mm to 10 mm, more preferably about 2 mm to about 8 mm, and most preferably about 2.5 mm to about 7 mm.

In the first aspect, the lengths LE, L1 and L2 of the engaging surfaces and the opposing surfaces in the width direction D3 are smaller than the actual lengths of these surfaces when the surfaces are inclined with respect to the longitudinal axis CL. When the surfaces have a trapezoidal shape or a parallelogram shape, which are not rectangular, the lengths LE, L1 and L2 can each be calculated as the average value among the surfaces.

In the first aspect, the engaging surface HE or 14E having a large length of projection Δ with respect to the opposing surface S1 or S2 thereof may mean one of the following two cases.

Case 1: Both of the engaging surface 11E (and/or 14E) and the opposing surface S1 (and/or S2) thereof are projecting from the outer peripheral edge 50 in the width direction D3.

Case 2: The engaging surface HE (and/or 14E) is projecting from the outer peripheral edge 50 in the width direction D3, but the opposing surface S1 (and/or S2) thereof is not projecting from the outer peripheral edge 50 in the width direction D3.

In the first aspect, the first engaging surface 11E facing toward a posterior D2 direction or an obliquely posterior direction means that the posterior surface of the medial cleat 11 forms the first engaging surface 11E. On the other hand, the second engaging surface 14E facing toward an anterior D1 direction or an obliquely anterior direction means that the anterior surface of the lateral cleat 14 forms the second engaging surface 14E.

The engaging surface 11E, 14E facing toward a posterior D2 direction or an anterior D1 direction means that the line of intersection 52 between the engaging surface 11E (14E) and the tread surface is orthogonal to the longitudinal axis CL. On the other hand, the engaging surface 11E, 14E facing toward an obliquely posterior (anterior) direction means that the line of intersection 52 is inclined with respect to the width direction D3.

In a second aspect of the present invention, a rubber-made outsole 5 includes a medial portion M, a lateral portion L, and a central portion CN between the medial portion and the lateral portion;

a plurality of rubber-made medial cleats 11, 31 projecting from a base surface 5S of the outsole 5 or the midsole 4 are provided in the medial portion M;

a plurality of rubber-made lateral cleats 14, 34 projecting from the base surface 5S of the outsole 5 or the midsole 4 are provided in the lateral portion L;

the medial cleats 11, 31 and the lateral cleats 14, 34 are spaced apart from each other in a width direction D3 perpendicular to the longitudinal axis CL of the outsole 5;

at least one cleat 11, 14, 31, 34 of the medial cleats and the lateral cleats includes a near-edge portion H which is placed near a medial edge or a lateral edge of the outsole 5, and a near-center portion S which is placed near the central portion of the outsole 5;

the near-edge portion H and the near-center portion S each include a tread surface TS;

the near-edge portion H and the near-center portion S are placed with respect to each other with a groove G having a width of 3 mm or less therebetween, or are continuous with each other in the width direction D3; and a value of compressive stiffness of the near-center portion S is smaller than that of the near-edge portion H, or a value of rubber hardness of the near-center portion S is smaller than that of the near-edge portion H.

The cleats placed in the medial portion M and the lateral portion L will exert an engaging force when running uphill or running downhill. Particularly, the value of compressive stiffness of the near-center portion S of each of the medial and lateral cleats is smaller than that of the near-edge portion H, or the value of rubber hardness of the near-center portion S is smaller than that of the near-edge portion H. Therefore, the cleats in the near-center portion S will easily deform to exert a great grip force.

On the other hand, the value of compressive stiffness and/or the value of rubber hardness of the near-edge portion H of the medial portion M or the lateral portion L is greater than that of the near-center portion S, and cleats are less likely to peel or chip. Thus, it is possible to suppress the lowering of the endurance of the outsole.

When running uphill or running downhill, the body is more likely to tilt or stagger sideways than on a flat ground, resulting in an unstable run. For this, the near-edge portion H is less likely to deform than the near-center portion S, which will suppress supination and pronation of the foot, and the run is likely to be stable.

In the second aspect, "the medial cleats 11, 31 and the lateral cleats 14, 34 are spaced apart from each other in a width direction D3 perpendicular to the longitudinal axis CL of the outsole 5" means that the medial and lateral cleats are spaced apart from each other in the width direction D3 by 3 mm or more, preferably 5 mm to 70 mm, more preferably 8 mm to 65 mm, and most preferably about 10 mm to about 60 mm.

In the second aspect, "the near-edge portion H and the near-center portion S are placed with respect to each other with a groove G having a width of 3 mm or less therebetween, or are continuous with each other in the width direction D3" means that the cleats 11, 31, 14 and 34 can function as a single cleat. The groove G having a width of 3 mm or less is a limitation provided to exclude a group of cleats that cannot function as a single cleat when the width of the deep groove G exceeds 3 mm.

The groove G is not a shallow groove for forming a projection/depression on the surface of the cleats, but it means a deep groove having a depth of at least 50% or more of the height of projection Hp of the cleat. The groove G preferably extends to reach the base surface 5S, and most preferably extends past the base surface 5S. Therefore, when the depth is less than 50% of the height of projection Hp, the near-edge portion H and the near-center portion S are considered to be continuous with each other in the width direction D3.

In this second aspect, the value of compressive stiffness Ea of the near-center portion S (the near-edge portion H) is generally represented by Expression (1) below.

$$Ea = W \cdot Hp / \lambda \quad (1)$$

W: compressive load applied on near-center portion S (or near-edge portion H)

Hp: height of projection of cleat

λ: contraction of cleat

Generally, the ratio of the true cross-sectional area of a cleat (the near-center portion S or the near-edge portion H) with respect to the apparent planar cross-sectional area of the cleat (the area of a portion of the near-center portion S (the near-edge portion H) of the cleat that is surrounded by an envelope) has a positive correlation with the value of compressive stiffness Ea. That is, when a groove or a projection/depression is present on the tread surface of the near-center portion S or the near-edge portion H, such a groove or a projection/depression lowers the value of compressive stiffness Ea.

In the second aspect, when "a value of rubber hardness of the near-center portion S is smaller than that of the near-edge portion H", the value of compressive stiffness Ea of the near-center portion S is generally smaller than the value of compressive stiffness Ea of the near-edge portion H. This is because rubber hardness has a positive correlation with the Young's modulus, which is the stiffness of the material.

The outsole is preferably formed from a foamed material or a non-foamed material of a rubber, and it is preferable in practice that the hardness of the near-edge portion H and the near-center portion S is about 50 degrees to about 95 degrees in terms of JIS K 6301 C hardness.

The hardness difference between the near-edge portion H and the near-center portion S is preferably about 5 degrees to about 30 degrees, and most preferably about 7 degrees to about 20 degrees, in terms of C hardness. The advantageous effects are difficult to realize when the hardness difference is small. On the other hand, when the hardness difference is large, it is likely to be out of the practical range of hardness.

In view of the above, the hardness of the near-edge portion H of the outsole is preferably about 70 degrees to about 92 degrees, and most preferably about 75 degrees to about 90 degrees, in terms of C hardness.

On the other hand, the near-center portion S of the outsole is preferably about 55 degrees to about 80 degrees, and most preferably about 60 degrees to about 75 degrees, in terms of C hardness.

Note that in the present specification (invention), the C hardness means the value measured with a durometer of the JIS K 6301C type. Moreover, "the value of hardness is . . . small" means that the value measured with a durometer for measuring the hardness of a viscoelastic material such as a rubber or a resin is small.

DESCRIPTION OF EMBODIMENTS

Figure 1:
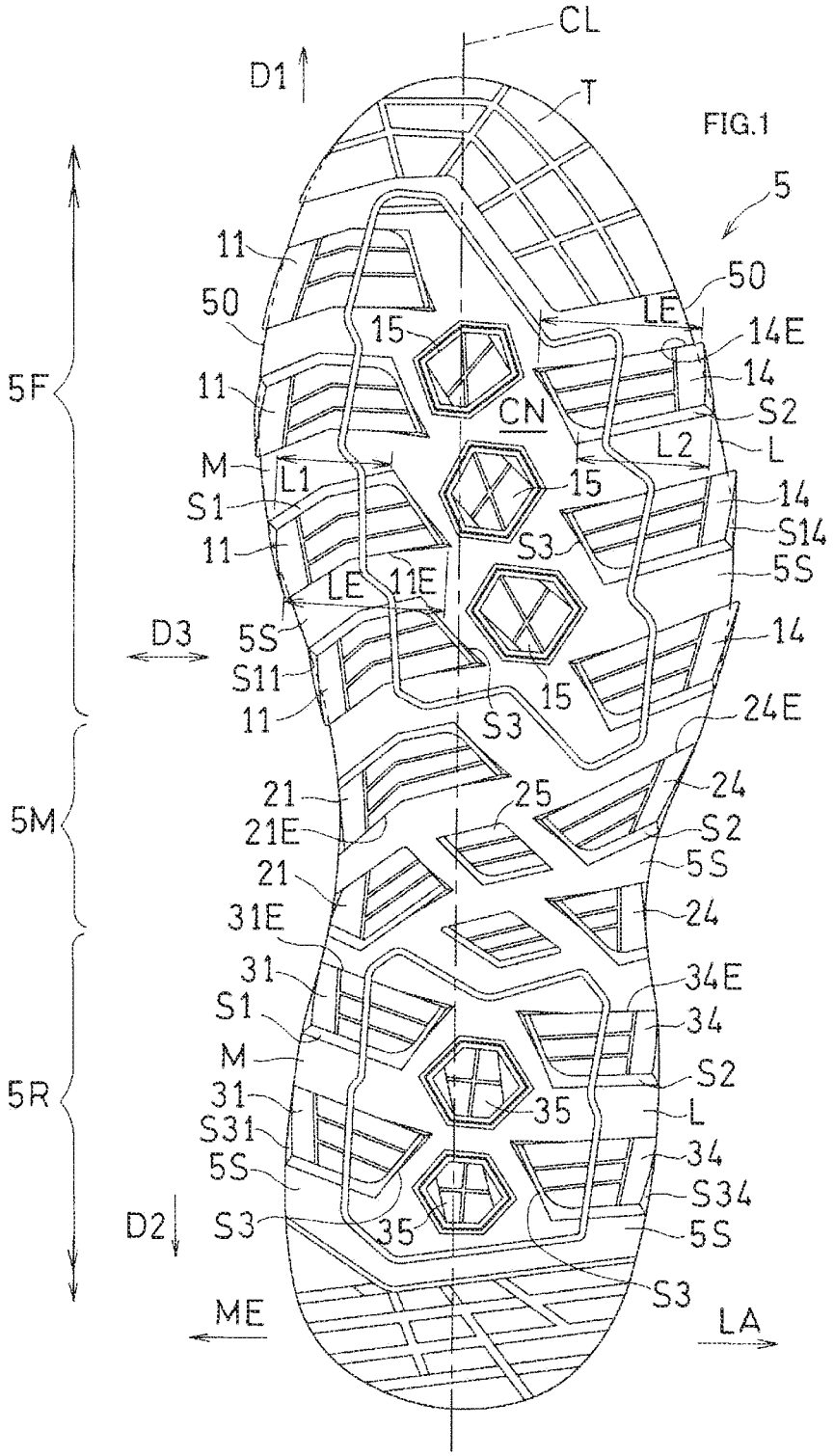
FIG. 1 is a schematic plan view showing Embodiment 1 of a shoe sole of the present invention.

In the first aspect, the number of combinations of a first engaging surface 11E that satisfies at least one of the requirements (a1) to (c1) and a second engaging surface 14E that satisfies at least one of the requirements (a2) to (c2) is 49. Preferred examples of the first aspect will now be described below.

In the first aspect, it is preferred that the requirements (a1) and (a2) are satisfied.

In this case, the medial and lateral engaging surfaces HE and 14E are long in the width direction D3, and a great engaging force can be expected when running on uphill and downhill road surfaces.

In the first aspect, it is preferred that the requirements (b1) and (b2) are satisfied.

In this case, the medial and lateral engaging surfaces HE and 14E are closer to 90° than the opposing surfaces S1 and S2, and a great engaging force can be expected when running on uphill and downhill road surfaces.

In the first aspect, it is preferred that the requirements (c1) and (c2) are satisfied.

In this case, the medial and lateral engaging surfaces HE and 14E are projecting more than the opposing surfaces S1 and S2 in the width direction D3 from the outer peripheral edge 50 of the base surface 5S, thereby providing long engaging surfaces, and a great engaging force can be expected when running on uphill and downhill road surfaces.

In the first aspect, it is more preferred that the requirements (a1), (a2), (b1) and (b2) are satisfied. In the first aspect, it is more preferred that the requirements (a1), (a2), (c1) and (c2) are satisfied. In the first aspect, it is more preferred that the requirements (b1), (b2), (c1) and (c2) are satisfied.

In these more preferred examples, a further increase in the engaging force can be expected when running on uphill and downhill road surfaces.

In the first aspect, it is particularly preferred that the requirements (a1), (a2), (b1), (b2), (c1) and (c2) are satisfied.

In this case, a significant increase in the engaging force can be expected.

In the first aspect, it is preferred that each of the cleats 11 and 14 further includes a side (lateral) engaging surface S3 extending in a front-rear direction along the longitudinal axis CL or in an obliquely front-rear direction toward the central portion. Such a side engaging surface S3 may be parallel to the longitudinal axis CL or may be inclined with respect to the longitudinal axis CL.

The side engaging surface S3 will exert an engaging force toward the width direction D3. When the side engaging surface S3 extends in an obliquely front-rear direction, the side engaging surface S3 increase the engaging force in a direction that is orthogonal to that direction.

In the first aspect, it is preferred that the first engaging surface 11E of each of the medial cleats 11 includes a surface that faces toward an obliquely posterior and lateral LA direction.

In this case, medial cleats of the forefoot portion upon open-stance landing will strongly kick an uphill road surface toward an obliquely posterior direction. Thus, a great propelling force will be obtained by running uphill with open-stance landing.

In the first aspect, it is preferred that the second engaging surface 14E of each of the lateral cleats 14 includes a surface that faces toward an obliquely anterior and medial ME direction.

In this case, lateral cleats of the forefoot portion upon open-stance landing will exert a stable braking force toward an obliquely anterior direction. Therefore, by running downhill with open-stance landing, slippage on a downhill road surface is suppressed.

In the first aspect, it is more preferred that the first engaging surface 11E of each of the medial cleats 11 includes a surface facing toward an obliquely posterior and lateral LA direction, and the second engaging surface 14E of each of the lateral cleats 14 includes a surface facing toward an obliquely anterior and medial ME direction.

In this case, a great propelling force is obtained when running uphill with open-stance landing, and a stable braking force is obtained when running downhill.

In the first aspect, there is no particular limitation on the length of the engaging surfaces in the width direction D3. However, when the length of the engaging surfaces in the width direction D3 is sufficiently large, the engaging force is likely to be increased sufficiently.

In view of the above, in the first aspect, it is preferred that the length LE of the second engaging surface 14E of each of the lateral cleats 14 in the width direction D3 is set to be 20% to 50% of a width of an area of the outsole 5 where the lateral cleat 14 is provided.

It is similarly preferred that the length LE of the first engaging surface 11E of each of the medial cleats 11 in the width direction D3 is set to be 20% to 50% of a width of an area of the outsole 5 where the medial cleat 11 is provided.

It is more preferred that the ratio of the length LE in the width direction D3 is 25% to 50%. When the ratio exceeds 50%, the cleats 11 and 14 will be too long in the width direction D3, thereby lowering the engaging force in the lateral direction, or making the sole feel hard, or increasing the weight of the outsole.

In the first aspect, it is preferred that the shoe sole further includes one or more auxiliary cleats 15 between the medial cleats 11 and the lateral cleats 14 at one or more positions that are spaced apart from the medial cleats 11 and the lateral cleats 14.

In this case, the medial and lateral cleats 11 and 14 will not be too long in the width direction D3. Therefore, the engaging force in the lateral direction is unlikely to be lowered, or the sole is unlikely to feel hard, or a decrease in the weight of the outsole can be expected.

In the first aspect, it is preferred that the first engaging surface 11E projects in the width direction D3 from the outer peripheral edge 50 of the base surface 5S; and the first opposing surface S1 is placed within an area of the base surface 5S, which is surrounded by the outer peripheral edge 50 of the base surface 5S, without projecting from the outer peripheral edge 50.

In this case, the first engaging surfaces 11E projecting on the medial side in the width direction D3 exert a great engaging force, and the first opposing surfaces S1 are not projecting, thereby suppressing an increase in the weight of the outsole. Note that in this case, the first engaging surfaces HE are projecting toward the other foot, and will therefore not contact others.

In the first aspect, it is preferred that the second engaging surface 14E projects in the width direction D3 from the outer peripheral edge 50 of the base surface 5S; and the second opposing surface S2 is placed within an area of the base surface 5S, which is surrounded by the outer peripheral edge 50 of the base surface 5S, without projecting from the outer peripheral edge 50.

In this case, the second engaging surfaces 14E projecting on the lateral side in the width direction D3 exert a great engaging force, and the second opposing surfaces S2 are not projecting, thereby suppressing an increase in the weight of the outsole.

In the first aspect, it is more preferred that the first engaging surface HE projects in the width direction D3 from the outer peripheral edge 50 of the base surface 5S;

the first opposing surface S1 is placed in a non-projecting manner within an area of the base surface 5S that is surrounded by the outer peripheral edge 50;

the second engaging surface 14E projects in the width direction D3 from the outer peripheral edge 50 of the base surface 5S; and the second opposing surface S2 is placed in a non-projecting manner within an area of the base surface 5S that is surrounded by the outer peripheral edge 50.

In this case, the engaging surfaces 11E and 14E projecting in the width direction D3 exert a great engaging force, and the opposing surfaces S1 and S2 are not projecting, thereby further suppressing an increase in the weight of the outsole.

In the first aspect, it is preferred that an upper end of the first and/or second engaging surface 11E, 14E is placed within an area of the base surface 5S that is surrounded by the outer peripheral edge 50, and a most near-edge projecting end (tip) 53 of the medial cleat 11 (and/or the lateral cleat 14) on a line of intersection 52 between a tread surface TS of the medial cleat 11 (and/or the lateral cleat 14) to be in contact with a road surface and the first engaging surface HE (and/or the second engaging surface 14E) is projecting in the width direction D3 from the outer peripheral edge 50.

In this case, a projecting portion 51 of the first and/or second engaging surface 11E, 14E has a shape that is pointed toward the most projecting end (tip) 53. Therefore, it is possible to further suppress an increase in the weight of the outsole while increasing the engaging force.

Preferred examples of the second aspect will now be described below.

In the second aspect, it is preferred that the value of rubber hardness of the near-center portion S is smaller than that of the near-edge portion H.

Setting the compressive stiffness by means of grooves and projections/depressions is effective in lowering the compressive stiffness in areas that are close to the tread surface. However, lowering the compressive stiffness in areas of cleats that are closer to the base surface is difficult to realize.

In contrast, when the value of rubber hardness of the near-center portion S is small, it is possible to easily lower the stiffness not only near the tread surface but also over a deep area of the cleats.

In the second aspect, it is preferred that those of the medial cleats 11, 31 that are arranged (lined up) in a front-rear direction each include the near-edge portion H and the near-center portion S; and those of the lateral cleats 14, 34 that are arranged (lined up) in the front-rear direction each include the near-edge portion H and the near-center portion S.

In this case, the near-edge portion H of the medial and lateral cleats is less likely to deform than the near-center portion S thereof, which will further suppress supination and pronation of the foot. Particularly, when running uphill or running downhill, the sideway tilting or staggering of the body is suppressed, and the running posture is likely to be stable.

In the second aspect, it is preferred that the medial cleats 11 arranged in the front-rear direction and the lateral cleats 14 arranged in the front-rear direction are placed in the forefoot portion 5F of the outsole 5.

In this case, the forefoot portion stabilizing function is improved.

In the second aspect, it is more preferred that a value of compressive stiffness and/or rubber hardness of a soft area AS of the outsole 5 from the near-center portion S of the medial cleats 11 to the near-center portion S of the lateral cleats 14 in the forefoot portion 5F is smaller than that of the near-edge portion H of the medial and lateral cleats 11, 14 in the forefoot portion 5F.

In this example, the soft area AS in the central portion CN of the outsole 5 is likely to be compressed, whereas the near-edge portion H is unlikely to be compressed. Therefore, the load is likely to localize in the soft area AS in the central portion CN, thereby improving the running stabilizing function, and the medial and lateral near-edge portions H are likely to contact the road surface, realizing a great engaging force.

The soft area AS between the near-center portion S and the near-center portion S serves as a soft structure, thereby suppressing slippage by means of the low-hardness rubber when the central portion CN of the forefoot portion 5F comes into contact with a hard stone or rock.

In the second aspect, it is more preferred that a hard area AH having a greater compressive stiffness and/or rubber hardness than a compressive stiffness and/or rubber hardness of the soft area AS is provided in the medial portion M, the lateral portion L and a tip portion T of the forefoot portion 5F.

In this case, the hard area AH in the medial portion M and the lateral portion L of the forefoot portion 5F is likely to contribute to suppressing slippage and increasing the engaging force.

The hard area AH in the tip portion T can suppress the damage to the tip portion T of the outsole 5 resulting from the tip portion T coming into contact with a rock or a hard road surface.

In the second aspect, it is preferred that those of the medial cleats 31 that are arranged in the front-rear direction and those of the lateral cleats 34 that are arranged in the front-rear direction are placed in a rearfoot portion 5R of the outsole 5.

In this case, it is believed that the near-edge portions H of the medial and lateral cleats 31 and 34 of the rearfoot portion 5R can also serve to suppress overpronation or oversupination.

That is, this improves the rearfoot portion stabilizing function.

In the second aspect, it is more preferred that a value of compressive stiffness and/or rubber hardness of a soft area AS of the outsole 5 from the near-center portion S of the medial cleats 31 to the near-center portion S of the lateral cleats 34 in the rearfoot portion 5R is smaller than that of the near-edge portion H of the medial and lateral cleats 31, 34 in the rearfoot portion 5R.

In this example, the soft area AS in the central portion CN of the rearfoot portion 5R is likely to be compressed, whereas the near-edge portion H is unlikely to be compressed. Therefore, the medial and lateral near-edge portions H are likely to contact the road surface, thereby improving the running stability and realizing a great engaging force.

The soft area AS between the near-center portion S and the near-center portion S serves as a soft structure, thereby suppressing slippage when the central portion CN of the rearfoot portion 5R comes into contact with a hard stone or rock.

In the second aspect, it is more preferred that a hard area AH having a greater value of compressive stiffness and/or rubber hardness than a compressive stiffness and/or rubber hardness of the soft area AS is provided in the medial portion M, the lateral portion L and a rear end portion CR of the rearfoot portion 5R.

In this case, as with the forefoot portion described above, the hard area AH in the medial portion M and the lateral portion L of the rearfoot portion 5R is likely to contribute to suppressing slippage and increasing the engaging force. The hard area AH in the rear end portion CR can suppress the damage to the rear end portion CR of the outsole 5 resulting from the rear end portion CR coming into contact with a rock or a hard road surface.

In the second aspect, it is preferred that the groove G is provided between the near-center portion S and the near-edge portion H; and a width of the groove G is set to be 0.1 mm to 3.0 mm.

When the groove G is absent between the near-center portion S and the near-edge portion H, it will be more difficult for the near-center portion S to deform as it is restrained by the near-edge portion H. In contrast, with the presence of the groove G between the near-center portion S and the near-edge portion H, the flexible near-center portion S is likely to deform, thereby realizing the intended advantageous effects.

The near-edge portions H and the near-center portions S, which have different hardnesses from each other, will be molded with a high precision in the area of the groove G.

The width of the groove G is preferably 0.1 mm or more in order to realize the advantageous effects and in view of production. On the other hand, when the width of the groove G is excessive, the cleats will have excessive void portions, and their function as cleats is likely to lower. In view of this, the width of the groove G is preferably 3.0 mm or less.

In order to realize advantageous effects and in view of the above, in the second aspect, it is more preferred that the groove G extends from the tread surface TS to the base surface 5S.

In the second aspect, it is more preferred that another groove G1, G2 is formed on the outsole 5 between the soft area AS and the hard area AH, the groove G1, G2 being continuous with the groove G.

In this case, the continuity of deformation between the soft area AS and the hard area AH is likely to be cut off.

The hard area AH and the soft area AS, which have different hardnesses from each other, will be molded with a high precision in the area of the groove G1, G2.

In the second aspect, it is more preferred that each cleat includes the engaging surface, and an opposing surface S1, S2 on an opposite side from the engaging surface, and the engaging surface of each cleat includes a projecting portion 51 projecting in the width direction D3 from the outer peripheral edge 50 of the base surface 5S.

In this case, the projecting portion 51 of the engaging surface 11E, 14E projecting in the width direction D3 increases the engaging force.

In the second aspect, it is more preferred that an upper end of the engaging surface is arranged within an area of the base surface 5S that is surrounded by the outer peripheral edge 50, and the projecting portion 51 includes a most near-edge projecting end (tip) 53 which is a nearest-to-edge portion of the medial cleat 11 (and/or the lateral cleat 14) on a line of intersection 52 between a tread surface TS to be in contact with a road surface and the engaging surface, the projection tip 53 projecting in the width direction D3 from the outer peripheral edge 50.

In this case, the projecting portion 51 of the engaging surface has a shape that is pointed toward the most projecting end 53. Therefore, it is possible to increase the engaging force and suppress the weight of the outsole.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

Embodiments

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Embodiments of the present invention will now be described with reference to the drawings.

The embodiments are directed to a shoe sole of a shoe for trail running or walking, for example.

Figure 3:
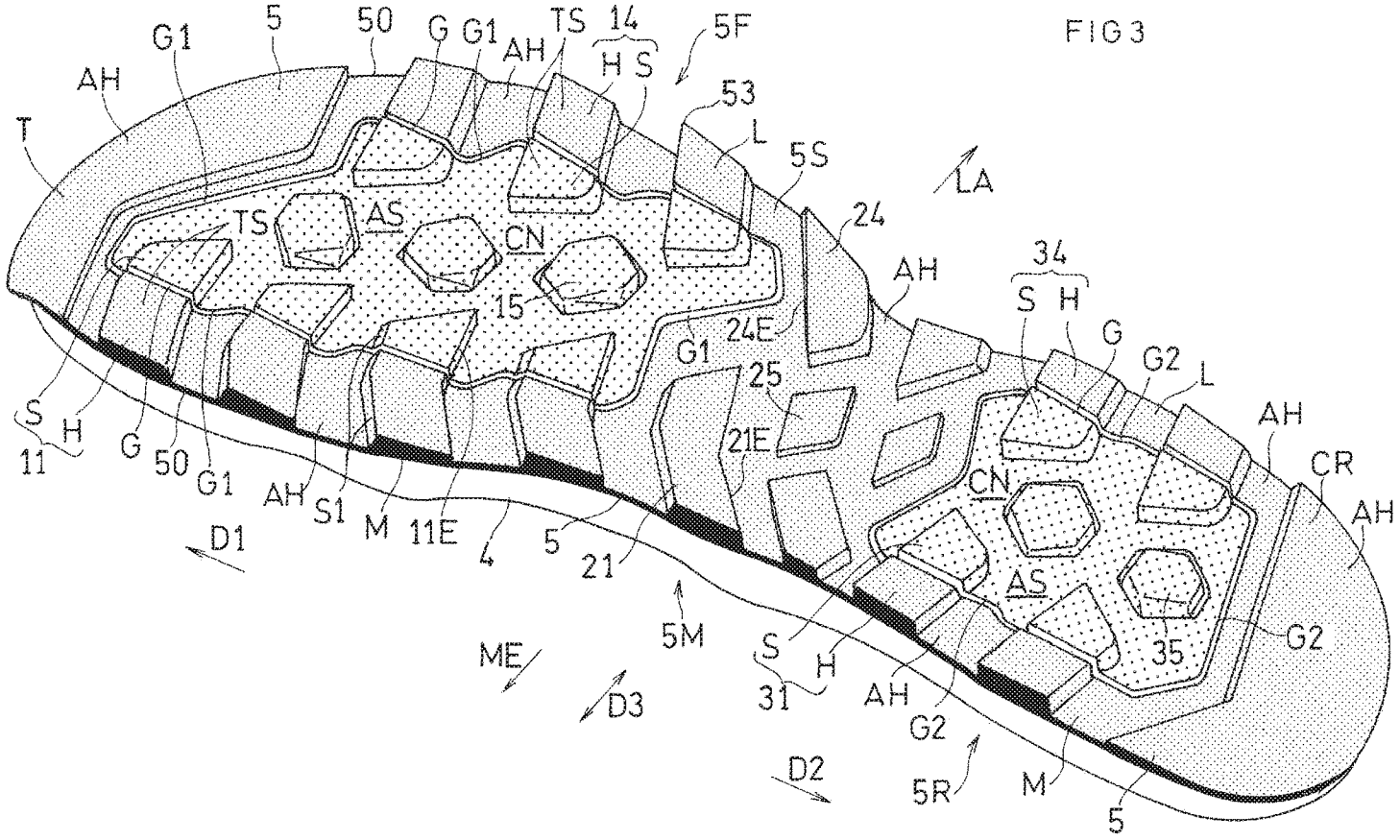
FIG. 3 is a schematic perspective view of the shoe sole. In this figure, the solid black area represents the side surface of the outsole, the densely-dotted area represents the hard area, and the coarsely-dotted area represents the soft area.

As shown in FIG. 3, the shoe sole includes the rubber-made outsole 5 and the resin-made midsole 4. Note that an upper (not shown) covering the instep of the foot is provided over the shoe sole.

The midsole 4 includes a midsole body made of a resin-made foamed material such as EVA, for example. Note that "made of resin" means that a resin component such as a thermoplastic component is contained, and may include any other suitable component. The midsole 4 may be provided with a low-resilience material, a high-resilience material, a groove, etc.

The outsole 5 is made of rubber sponge, solid rubber, or the like, for example. The outsole 5 is a tread sole having a higher abrasion resistance than the foamed material of the midsole body, and typically has a higher hardness than the foamed material of the midsole body. Note that "made of rubber" means that it contains a natural rubber component or a synthetic rubber component, and it may contain any other component.

As shown in FIG. 1, the outsole 5 includes a plurality of first cleats 11, 14, second cleats 21, 24 and third cleats 31, 34, which are made of rubber and which are placed in the forefoot portion 5F, the midfoot portion 5M and the rearfoot portion 5R, respectively.

Figure 12:
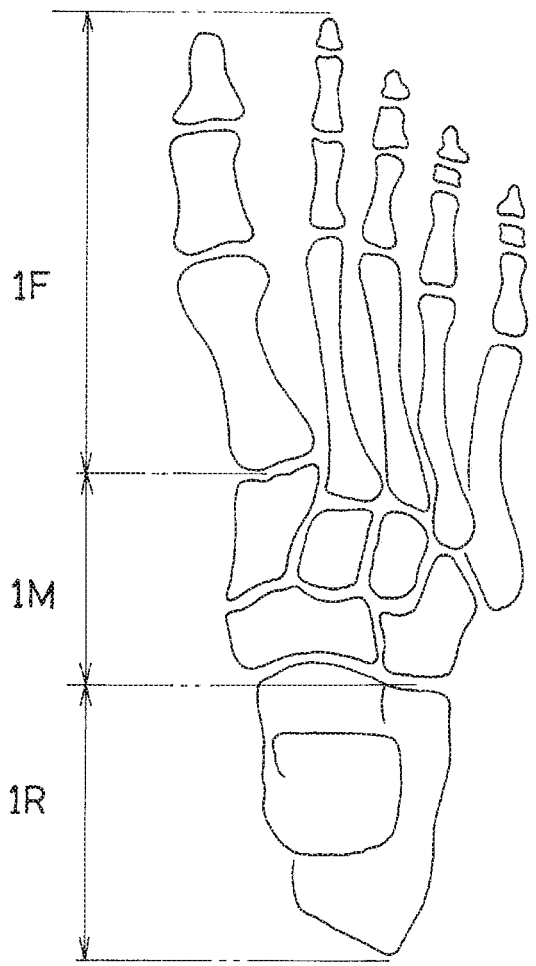
FIG. 12 is a bottom view showing the foot bone structure.

The forefoot portion 5F, the midfoot portion 5M and the rearfoot portion 5R refer to areas that cover the forefoot 1F, the midfoot 1M and the rearfoot 1R, respectively, of the foot of FIG. 12. The forefoot 1F includes five metatarsal bones and fourteen phalanges. The midfoot 1M includes a navicular bone, a cuboid bone and three cuneiform bones.

As shown in FIG. 3 to FIG. 6, the cleats are projecting downward (toward the road surface) from the base surface 5S of the outsole 5 of FIG. 3, and are formed integral with the outsole 5. Note that the base surface 5S refers to the bottom surface of a portion that has a generally constant thickness along the bottom surface of the midsole 4, and may include shallow grooves and small projections/depressions.

Figure 2:
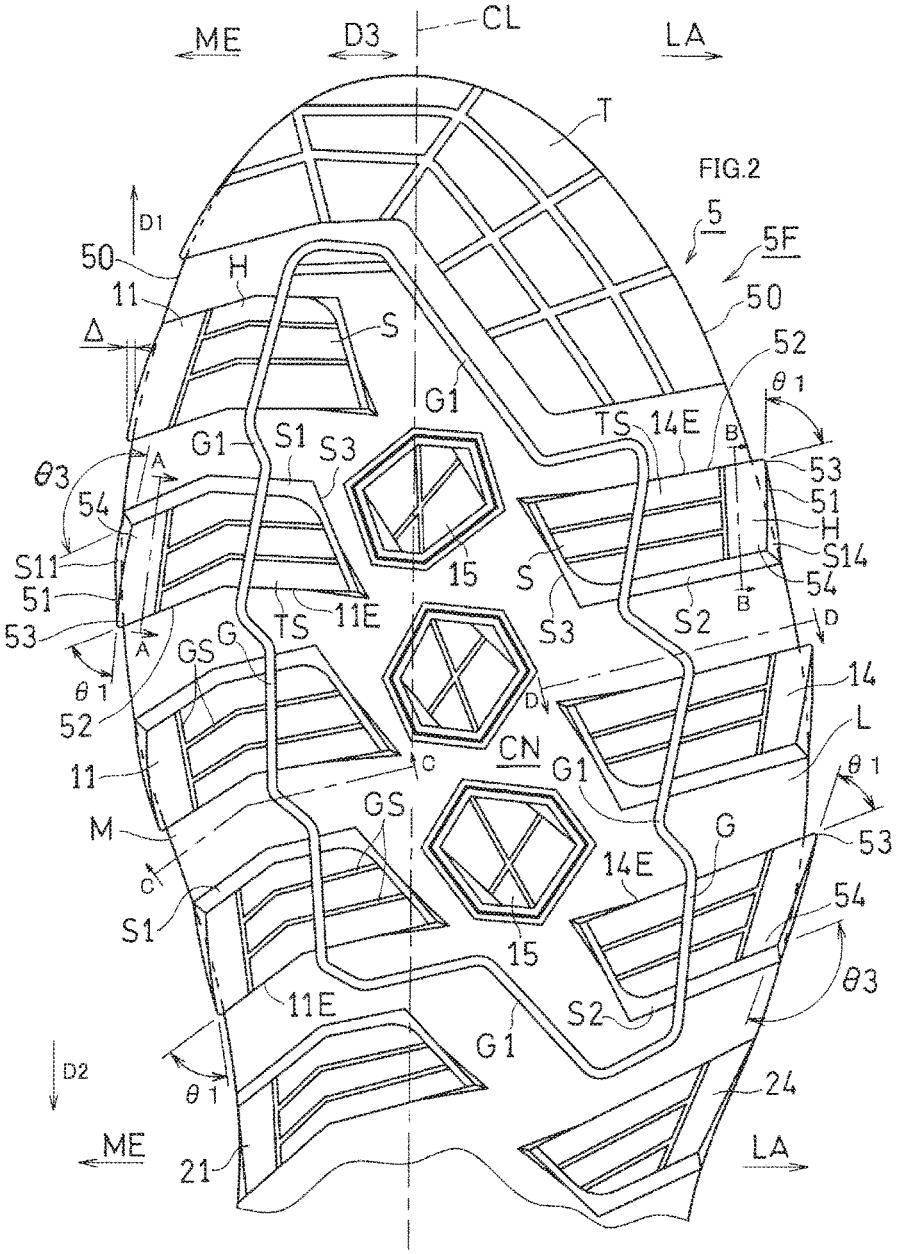
FIG. 2 is an enlarged plan view showing, on an enlarged scale, the forefoot portion of the shoe sole.

In the forefoot portion 5F shown on an enlarged scale in FIG. 2, the medial first cleats 11, which are placed on the medial side ME of the foot, of the first cleats 11, 14, have the first engaging surfaces 11E facing toward a posterior D2 direction or an obliquely posterior and lateral LA direction. On the other hand, the lateral first cleats 14, which are placed on the lateral side LA of the foot, of the first cleats 11 to 14, have the second engaging surfaces 14E facing toward an obliquely anterior and medial ME direction.

Note that in the central portion CN of the forefoot portion 5F, the midfoot portion 5M and the rearfoot portion 5R of FIG. 1, rubber-made auxiliary cleats 15, 25, 35 to be described below are formed integral with the outsole 5.

In the midfoot portion 5M shown in FIG. 3, the medial second cleats 21, which are placed on the medial side ME of the foot, of the second cleats 21, 24, have the engaging surfaces 21E facing toward an obliquely posterior and lateral LA direction. On the other hand, the lateral second cleats 24, which are placed on the lateral side LA of the foot, of the second cleats 21, 24, have the engaging surfaces 24E facing toward an obliquely anterior and medial ME direction.

Figure 6:
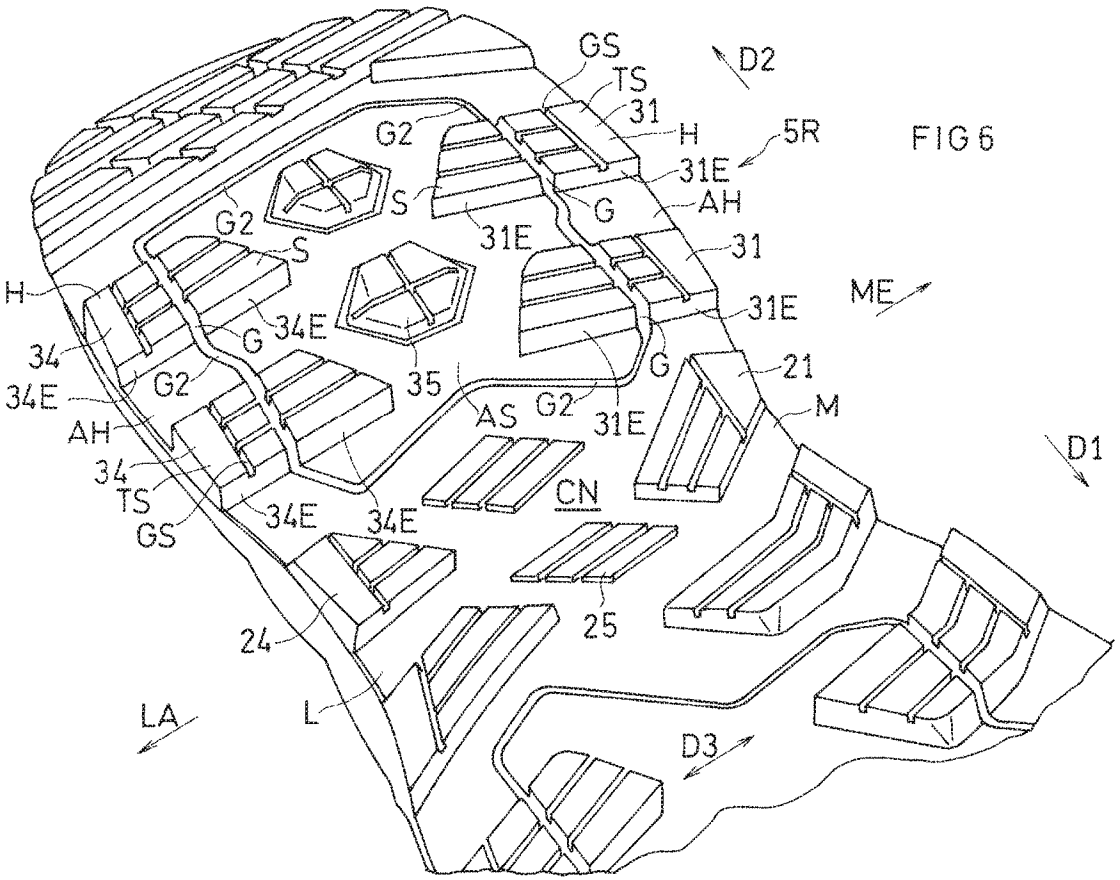
FIG. 6 is an enlarged perspective view showing the rearfoot portion of the shoe sole.

In the rearfoot portion 5R of FIG. 6, the medial third cleats 31, which are placed on the medial side ME of the foot, of the third cleats 31, 34 have the engaging surfaces 31E facing toward an obliquely anterior and lateral LA direction. On the other hand, the lateral third cleats 34, which are placed on the lateral side LA of the foot, of the third cleats 31, 34 have the engaging surfaces 34E facing toward an anterior D1 direction or an obliquely anterior and medial ME direction.

In FIG. 1, the medial cleats 11, 31 include the first engaging surfaces 11E, 31E and the first opposing surfaces S1 on the opposite side from the first engaging surfaces 11E, 31E. On the other hand, the lateral cleats 14, 34 include the second engaging surfaces 14E, 34E and the second opposing surfaces S2 on the opposite side from the second engaging surfaces 14E, 34E.

In FIG. 1, the medial cleats 11, 31 and the lateral cleats 14, 34 are spaced apart from each other in the width direction D3, which is orthogonal to the longitudinal axis CL of the outsole 5. The cleats 11, 31, 14 and 34 are provided with the side engaging surfaces S3 extending in the front-rear direction along the longitudinal axis CL or in an obliquely front-rear direction and facing toward the central portion CN.

In FIG. 1, the medial cleats 11, 31 include the medial side surfaces S11, S31 on the opposite side from the side engaging surfaces S3. On the other hand, the lateral cleats 14, 34 include the lateral side surfaces S14, S34 on the opposite side from the side engaging surfaces S3.

In FIG. 1, the medial side surfaces S11, S31 of the medial cleats 11, 31 are placed along the outer peripheral edge 50 (medial edge) on the medial side of the outsole 5. On the other hand, the lateral side surfaces S14, S34 of the lateral cleats 14, 34 are placed along the outer peripheral edge 50 (lateral edge) on the lateral side of the outsole 5.

In FIG. 2, the medial first cleats 11 are placed so as to be spaced apart from each other in the front-rear direction of the foot and placed along the medial edge so as to slightly project from the medial edge. On the other hand, the lateral cleats 14 are placed so as to be spaced apart from each other in the front-rear direction of the foot and placed along the lateral edge so as to slightly project from the lateral edge.

Note that at least some, more preferably a half or more, of the first cleats 11 and 14 are placed on the medial side ME or the lateral side LA of the forefoot portion 5F.

Figure 7A:
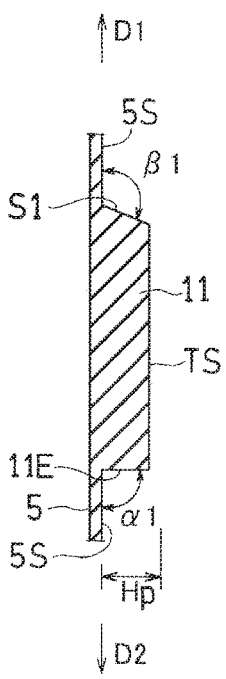
FIG. 7A, FIG. 7B, FIG. 7C and FIG. 7D are cross-sectional views of the outsole of FIG. 2.
Figure 7B:
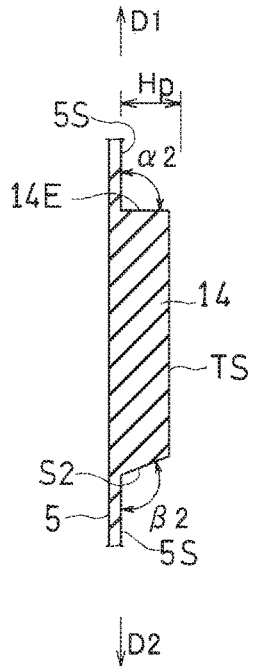

In FIG. 7A and FIG. 7B, the height of projection Hp of the first, second and third cleats 11, 14, 21, 24, 31, 34 from the base surface 5S is set to be about 3 mm to about 5 mm, for example.

A preferred range of the angle $\alpha$1 of the first engaging surfaces 11E and the engaging surfaces 21E and 31E (FIG. 1) with respect to the base surface 5S will now be described with reference to FIGS. 14(*a*) to 14(*c*).

Figure 14:
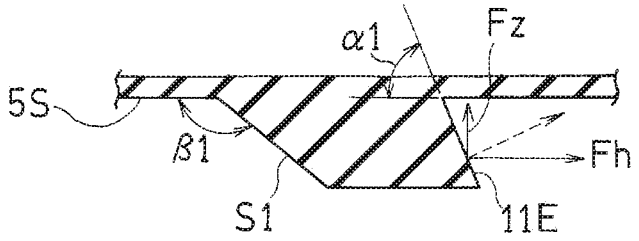
FIG. 14 is a cross-sectional view of a cleat.
Figure 14:
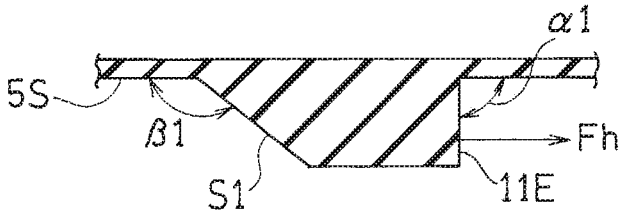
Figure 14:
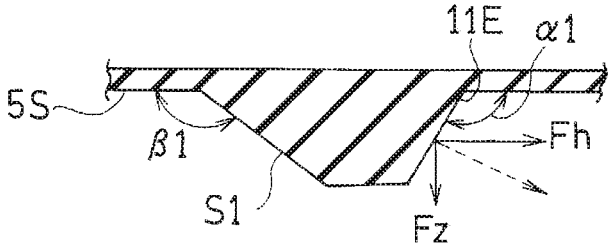

First, as shown in FIG. 14(*a*), when the angle $\alpha$1 is less than 90°, the force Fh acts in the horizontal direction, and there is also the load Fz acting vertically upward. In this case, the cleat collapses (intrudes) by the influence of the reaction force of the load Fz, thereby ensuring a sufficient projected area and efficiently transmitting the grip force.

Next, when the angle α1 is 90° or substantially 90° as shown in FIG. 14(*b*), only the force Fh in the horizontal direction acts dominantly. Also in this case, it can be said that the grip force can be transmitted efficiently.

On the other hand, when the angle α1 is greater than 90° as shown in FIG. 14(*c*), the force Fh acts in the horizontal direction, and there is also the load Fz acting vertically downward. In this case, the cleat rises by the influence of the reaction force of the load Fz, thereby decreasing the projected area. Therefore, it can be said that the grip force is not transmitted very efficiently.

Thus, the grip property is expected to improve when the angle α1 of the first engaging surfaces 11E and the engaging surfaces 21E and 31E (FIG. 1) with respect to the base surface 5S is made 90° or less than 90°. Note that also with the angle α2 of the second engaging surface 14E and the engaging surfaces 24E and 34E (FIG. 1) with respect to the base surface 5S shown in FIG. 7, the grip property is expected to improve when the angle α2 is made 90° or less than 90°, for similar reasons.

In FIG. 3, the cleats 11, 14, 31, 34 include the near-edge portions H placed on the medial side or on the lateral side of the outsole 5, and the near-center portions S placed near the central portion. The near-edge portion H and the near-center portion S each include the tread surface TS. The near-edge portion H and the near-center portion S are placed with the deep groove G having a width of 3 mm or less interposed therebetween, but they may be continuous with each other in the width direction D3 with no deep groove G interposed therebetween.

The medial cleats 11, 21, 31 and the lateral cleats 14, 24, 34 of FIG. 1 are spaced from each other in the width direction D3, which is orthogonal to the longitudinal axis CL of the outsole 5. The auxiliary cleats 15, 25, 35 are provided between the medial cleats 11, 21, 31 and the lateral cleats 14, 24, 34 at positions that are spaced apart from the medial cleats 11, 21, 31 and the lateral cleats 14, 24, 34.

In the case of the present embodiment, the first engaging surfaces HE and the engaging surfaces 21E and 31E of the medial cleats 11, 21, 31 shown in FIG. 1 are configured as follows with respect to the first opposing surfaces S1.

That is, the length LE in the width direction D3 of the first engaging surfaces 11E and the engaging surfaces 21E and 31E of FIG. 1 is longer than the length L1 of the first opposing surfaces S1 on the opposite side.

The angle α1 of the first engaging surfaces 11E and the engaging surfaces 21E and 31E with respect to the base surface 5S of FIG. 7A is closer to 90° than the angle 131 of the first opposing surfaces S1 on the opposite side with respect to the base surface 5S.

Moreover, as shown in FIG. 2, the first engaging surfaces 11E of the medial cleats 11 have the projecting portions 51 projecting from the outer peripheral edge 50 of the base surface 5S in the width direction D3. In contrast, the first opposing surfaces S1 of the medial cleats 11 are not projecting from the outer peripheral edge 50 in the width direction D3.

That is, a portion of each first engaging surface 11E is projecting from the outer peripheral edge 50 of the base surface 5S in the width direction D3. On the other hand, each first opposing surface S1 is placed in a non-projecting manner within an area of the base surface 5S that is surrounded by the outer peripheral edge 50.

In the case of the present embodiment, the second engaging surfaces 14E and the engaging surfaces 24E and 34E of the lateral cleats 14, 24, 34 shown in FIG. 1 are configured as follows with respect to the second opposing surfaces S2.

That is, the length LE in the width direction D3 of the second engaging surfaces 14E and the engaging surfaces 24E and 34E of FIG. 1 is longer than the length L2 of the second opposing surfaces S2 on the opposite side.

The angle α2 of the second engaging surfaces 14E and the engaging surfaces 24E and 34E with respect to the base surface 5S of FIG. 7B is closer to 90° than the angle B2 of the second opposing surface S2 on the opposite side with respect to the base surface 5S.

Moreover, as shown in FIG. 2, the second engaging surfaces 14E of the lateral cleats 14 each include the projecting portion 51 projecting from the outer peripheral edge 50 of the base surface 5S in the width direction D3. In contrast, the second opposing surfaces S2 of the lateral cleats 14 are not projecting from the outer peripheral edge 50 in the width direction D3.

That is, the second engaging surfaces 14E are projecting from the outer peripheral edge 50 of the base surface 5S in the width direction D3. On the other hand, each second opposing surface S is placed in a non-projecting manner within an area of the base surface 5S that is surrounded by the outer peripheral edge 50.

Figure 7C:
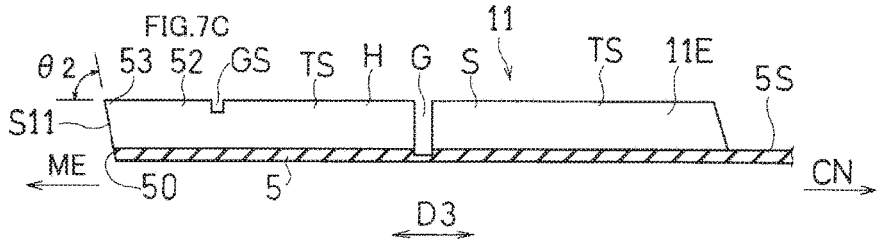
Figure 7D:
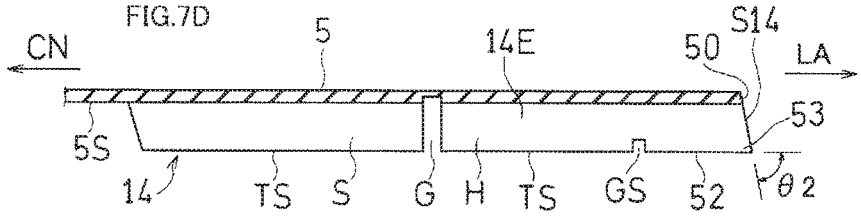

More specifically, in the forefoot portion 5F, the upper end (the lower end on the drawing sheet) of each of the engaging surfaces 11E, 14E of FIG. 2, FIG. 7C and FIG. 7D is placed within an area of the base surface 5S that is surrounded by the outer peripheral edge 50, and the most near-edge projecting end 53 of cleat on the line of intersection 52 between the tread surface TS to be in contact with the road surface and each of the engaging surfaces 11E, 14E is projecting from the outer peripheral edge 50 in the width direction D3.

The length LE in the width direction D3 of the second engaging surface 14E of each lateral cleat 14 of FIG. 1 is preferably set to be 20% or more, and more preferably 25% or more, of the width of the area of the outsole 5 where the lateral cleat 14 is provided. Although the length LE preferably has a certain width as described above, it may be a smaller width, e.g., a width of about 5% of the width of the area of the outsole 5 where the lateral cleat 14 is provided.

The length LE in the width direction D3 of the first engaging surface HE of each medial cleat 11 of FIG. 1 is preferably set to be 20% or more, and more preferably 25% or more, of the width of the area of the outsole 5 where the medial cleat 11 is provided. As with the lateral cleat 14, the length LE in the width direction D3 of the first engaging surface 11E of each medial cleat 11 can be set to be as small as about 5% of the width of the area of the outsole 5 where the medial cleat 11 is provided.

In the forefoot portion 5F of FIG. 2, the first engaging surface 11E of each medial cleat 11 faces toward a posterior D2 direction or an obliquely posterior direction.

Preferably, the first engaging surface 11E of the near-edge portion H of each medial cleat 11 may form a surface facing toward an obliquely posterior and lateral LA direction, and the first engaging surface 11E of the near-center portion S of each medial cleat 11 may form a surface facing toward a posteror direction or an obliquely posterior and lateral LA direction.

In the forefoot portion 5F of FIG. 2, the second engaging surface 14E of each lateral cleat 14 faces toward an anterior D1 direction or an obliquely anterior direction. More preferably, the second engaging surface 14E of each lateral cleat 14 includes a surface facing toward an obliquely anterior and medial ME direction.

Note that in the rearfoot portion 5R of FIG. 6, the engaging surface 31E of each medial cleat 31 faces toward an anterior D1 direction or an obliquely anterior and lateral LA direction. On the other hand, the engaging surface 34E of each lateral cleat 34 faces toward an anterior D1 or an obliquely anterior and medial ME direction.

The auxiliary cleats 15, 35 in the forefoot portion 5F and the rearfoot portion 5R of FIG. 3 each have a hexagonal columnar shape, for example, so that they can engage in many directions. Note that the auxiliary cleats 15, 35 in the forefoot portion 5F and the rearfoot portion 5R may each have a rectangular shape, or the like, as do the auxiliary cleats 25 in the midfoot portion 5M.

As the directions of the engaging surfaces are set as described above, slippage is unlikely to occur between the sole and the road surface in the phase of various uphill and downhill road surfaces.

Figure 4:
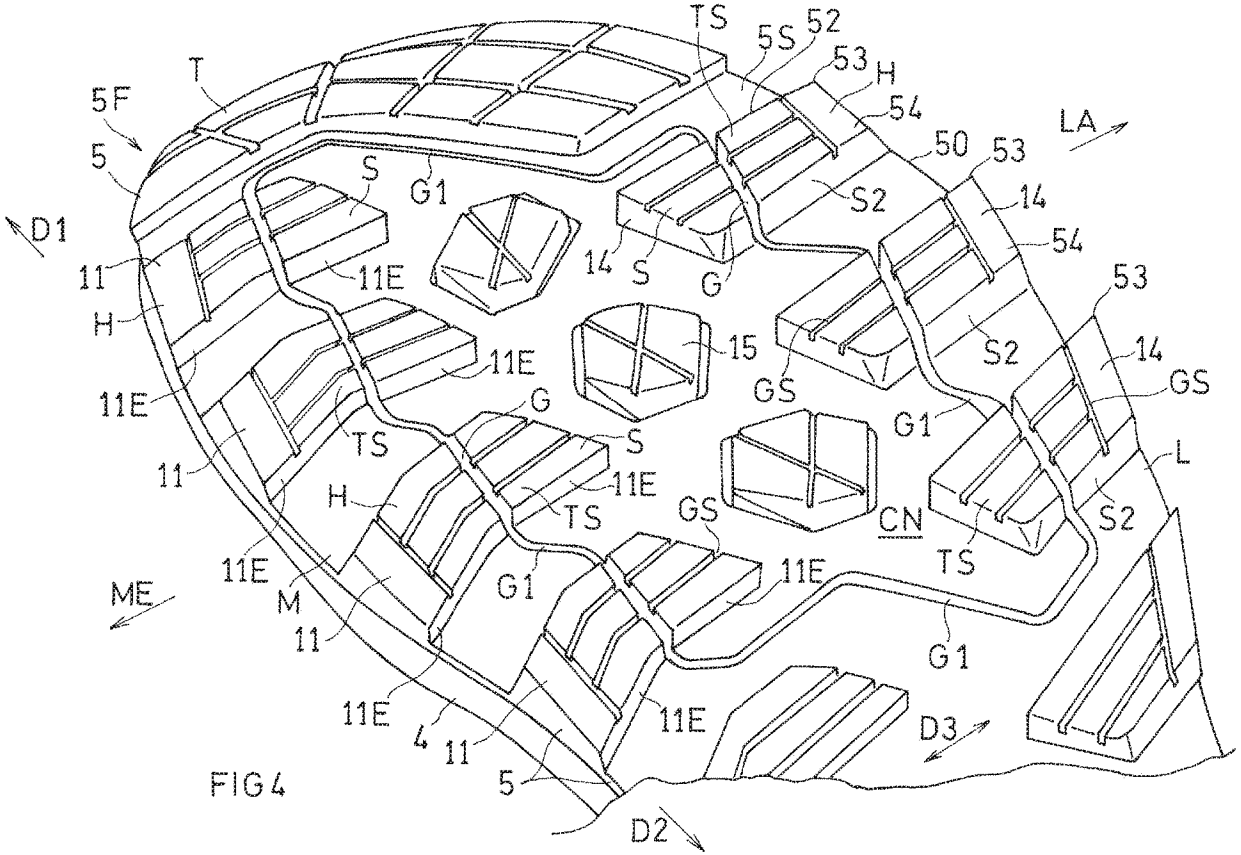
FIG. 4 is an enlarged perspective view showing the forefoot portion of the shoe sole.
Figure 5:
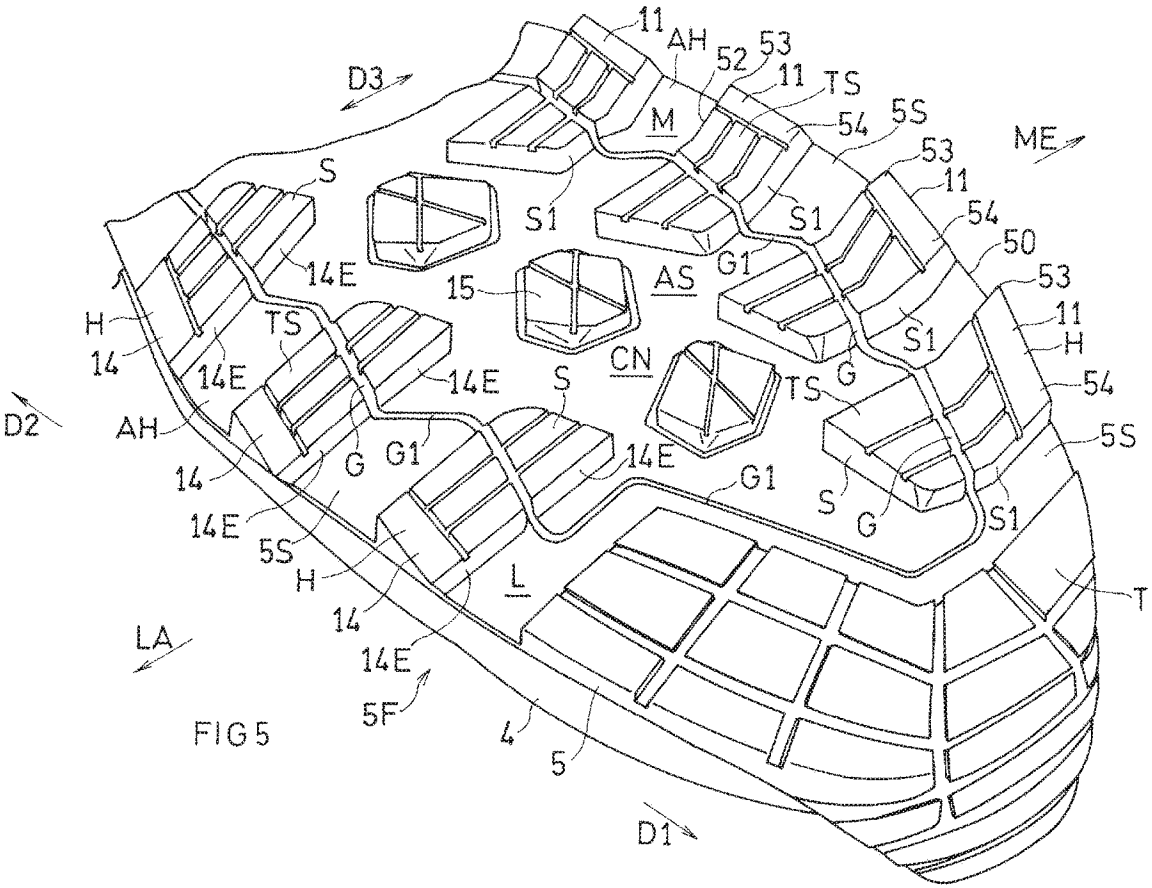
FIG. 5 is an enlarged perspective view showing the forefoot portion of the shoe sole.

In FIG. 4 and FIG. 5, the deep groove G extending from the tread surface TS to a position deeper than the base surface 5S is provided between the near-center portion S and the near-edge portion H. The width of the deep groove G is set to be about 1 mm to about 2 mm, for example.

The value of rubber hardness of the near-center portion S is smaller than that of the near-edge portion H. Thus, the value of compressive stiffness of the near-center portion S is smaller than that of the near-edge portion H.

In the forefoot portion 5F of FIG. 3, a portion of the outsole 5 from the near-center portions S of the medial cleats 11 to the near-center portions S of the lateral cleats 14 forms the soft area AS. The compressive stiffness and the value of rubber hardness of the soft area AS are less than those of the near-edge portion H of the forefoot portion 5F. The hard area AH where the compressive stiffness and the rubber hardness are greater than those of the soft area AS is provided in the medial portion M, the lateral portion L and the tip portion T of the forefoot portion 5F.

In the rearfoot portion 5R of FIG. 3, a portion of the outsole 5 from the near-center portions S of the medial cleats 31 to the near-center portions S of the lateral cleats 34 forms the soft area AS. The compressive stiffness and the value of rubber hardness of the soft area AS are less than those of the near-edge portion H of the rearfoot portion 5R. The hard area AH where the compressive stiffness and the rubber hardness are greater than those of the soft area AS is provided in the medial portion M, the lateral portion L and rear end portion CR of a rearfoot portion 5B.

In the forefoot portion 5F of FIG. 2, the medial side surfaces S11 and the lateral side surfaces S14 of the medial cleats 11 and the lateral cleats 14 are each defined by a spiral surface.

That is, on the tread surface TS of FIG. 2, the projecting ends 53 are projecting in the width direction D3 relative to the outer peripheral edge 50, whereas non-projecting ends 54 at the corners of the first and second opposing surfaces S1 and S2 are retracted relative to the outer peripheral edge 50 in the width direction D3. Moreover, the lines of intersection between the medial side surface S11 and the lateral side surface S14 and the base surface 5S are placed on the outer peripheral edge 50 as indicated by dotted lines.

In the medial cleats 11 and the lateral cleats 14 having such shapes as shown in FIG. 2, the first angle θ1 formed by the projecting end 53 on the tread surface TS is an acute angle (an angle smaller than 90°). The second angle θ2 formed between the medial side surface S11 and the lateral side surface S14 of FIG. 7C and FIG. 7D and the tread surface TS at the projecting end 53 is an acute angle. On the other hand, the third angle θ3 formed by the non-projecting end 54 on the tread surface TS of FIG. 2 is an obtuse angle (an angle larger than 90°).

Partitioning grooves G1, G2 are formed on the base surface 5S of the outsole 5 between the soft area AS and the hard area AH of FIG. 3, and the shallow partitioning grooves G1, G2 are continuous with the deep groove G. Along the partitioning grooves G1, G2, the thickness of the outsole 5 is smallest, and the outsole 5 is recessed upward from the base surface 5S.

In the case of the present embodiment, the grooves G and G1 (G2) continuous with each other are each formed in a loop in the forefoot portion 5F or the rearfoot portion 5B. Note that when a resin-made reinforcement device of a non-foamed material is provided, instead of the outsole 5, in the midfoot portion 5M, the grooves G and G1 (G2) continuous with each other will be in a non-loop shape and will be U-shaped.

As shown in FIG. 4 and FIG. 6, grooves GS, which are thinner and shallower than the deep groove G, may be formed on the tread surface TS of the cleats. These grooves GS decrease the ground-contact area of the tread surface TS, thereby decreasing the compressive stiffness of the cleats.

Therefore, when the near-edge portion H and the near-center portion S have the same hardness, the compressive stiffness of the near-edge portion H is made larger than that of the near-center portion S by making the ratio of the grooves GS in the near-edge portion H smaller than that in the near-center portion S, for example. Moreover, when a plurality of semispherical bumps are formed on the tread surface TS of the near-center portions S, for example, the compressive stiffness will be significantly smaller since the contact area between the tread surface TS and the road surface upon landing will be significantly smaller.

Figure 8:
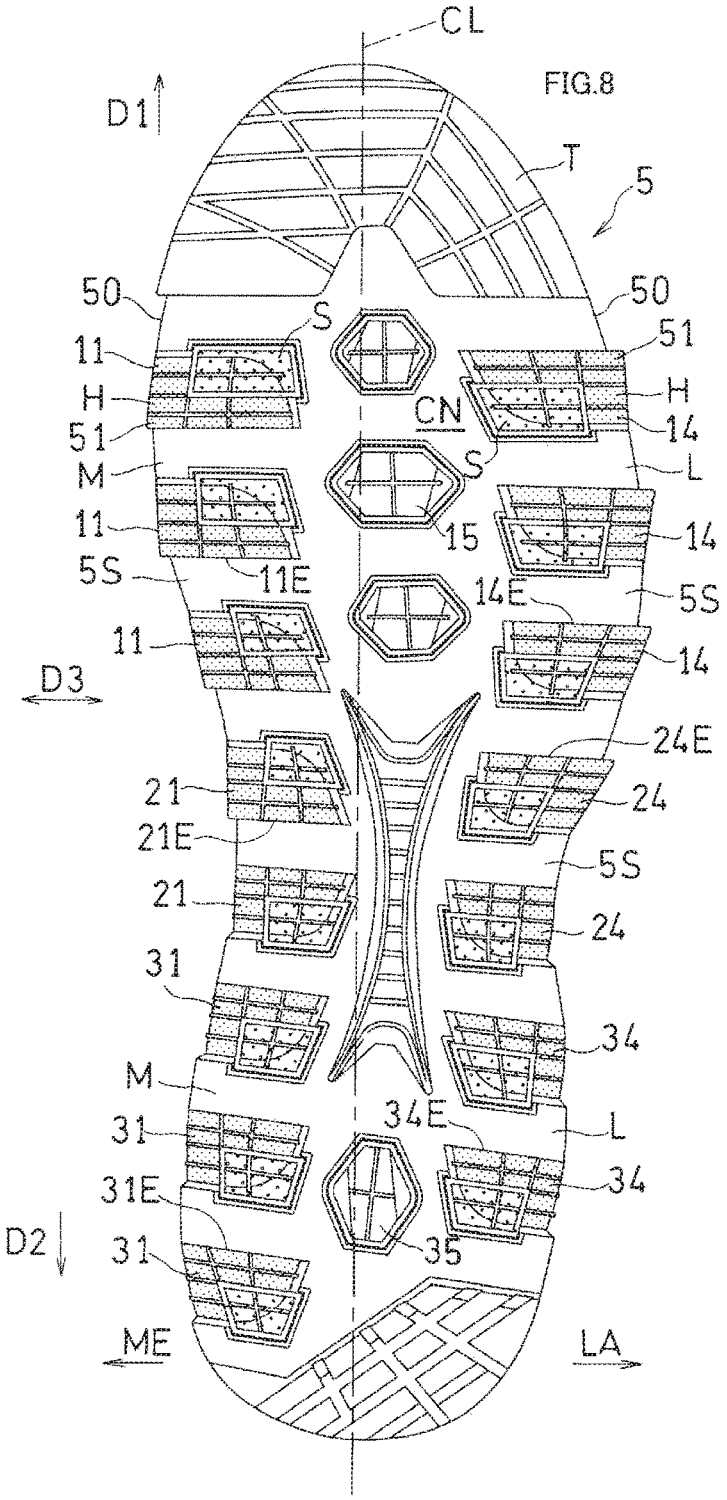
FIG. 8 is a plan view showing the shoe sole of Embodiment 2. In this figure, areas where the hardness of the medial and lateral cleats is high are densely dotted, and areas where the hardness is low are coarsely dotted.

FIG. 8 shows Embodiment 2.

As shown in the figure, the engaging surface 11E, 14E, 21E, 24E, 31E, 34E are each provided on a plane that is orthogonal to the longitudinal axis CL. That is, all the engaging surfaces 11E, . . . , are facing toward either an anterior D1 direction or a posterior D2 direction.

In the present embodiment, low-hardness portions of the near-center portions S of the first to third cleats 11, . . . , are coarsely dotted, whereas high-hardness portions of the near-center portions S and the near-edge portions H of the first to third cleats 11, . . . , are densely dotted. Thus, portions of the near-center portions S may be set to a low hardness.

Figure 9:
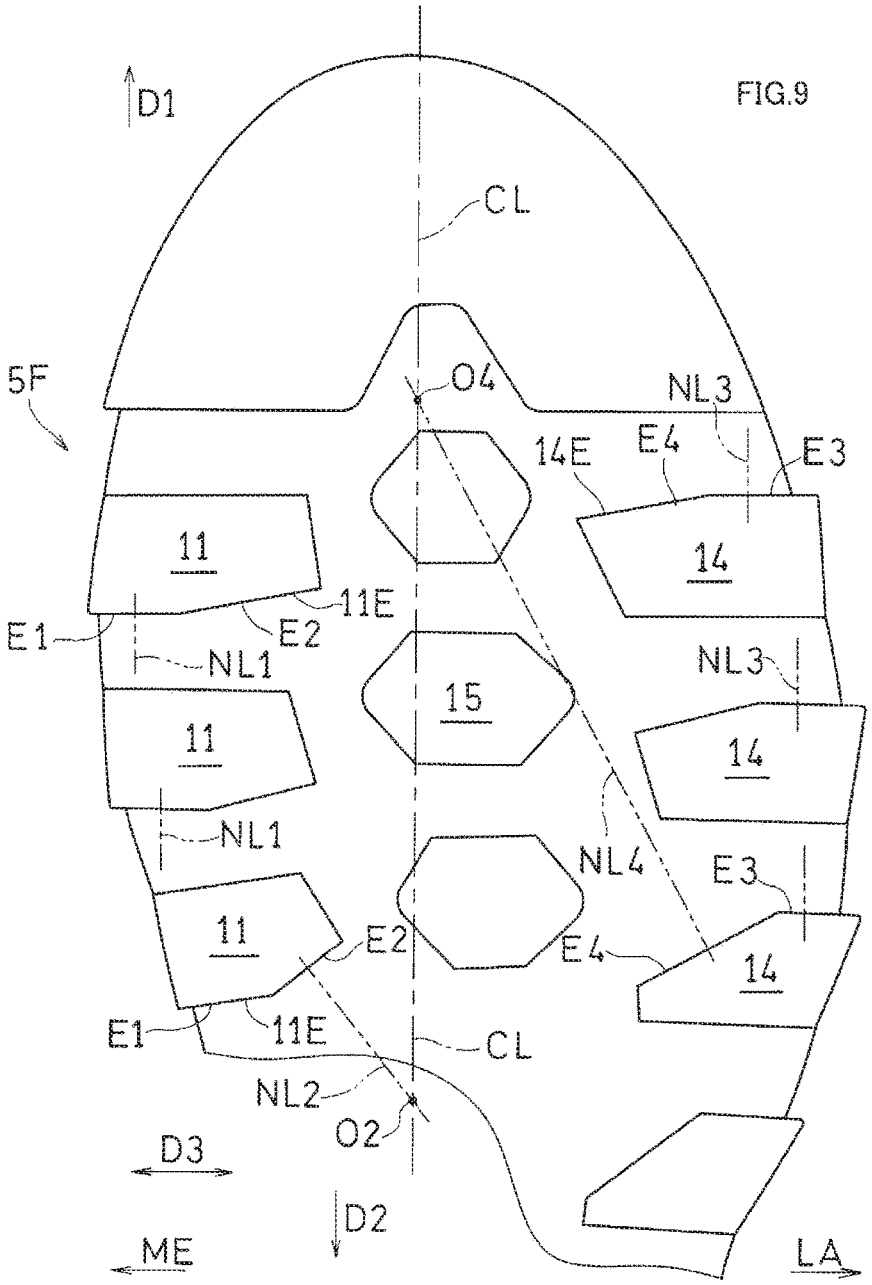
FIG. 9 is an enlarged plan view of the forefoot portion of a shoe sole of Embodiment 3.
Figure 10:
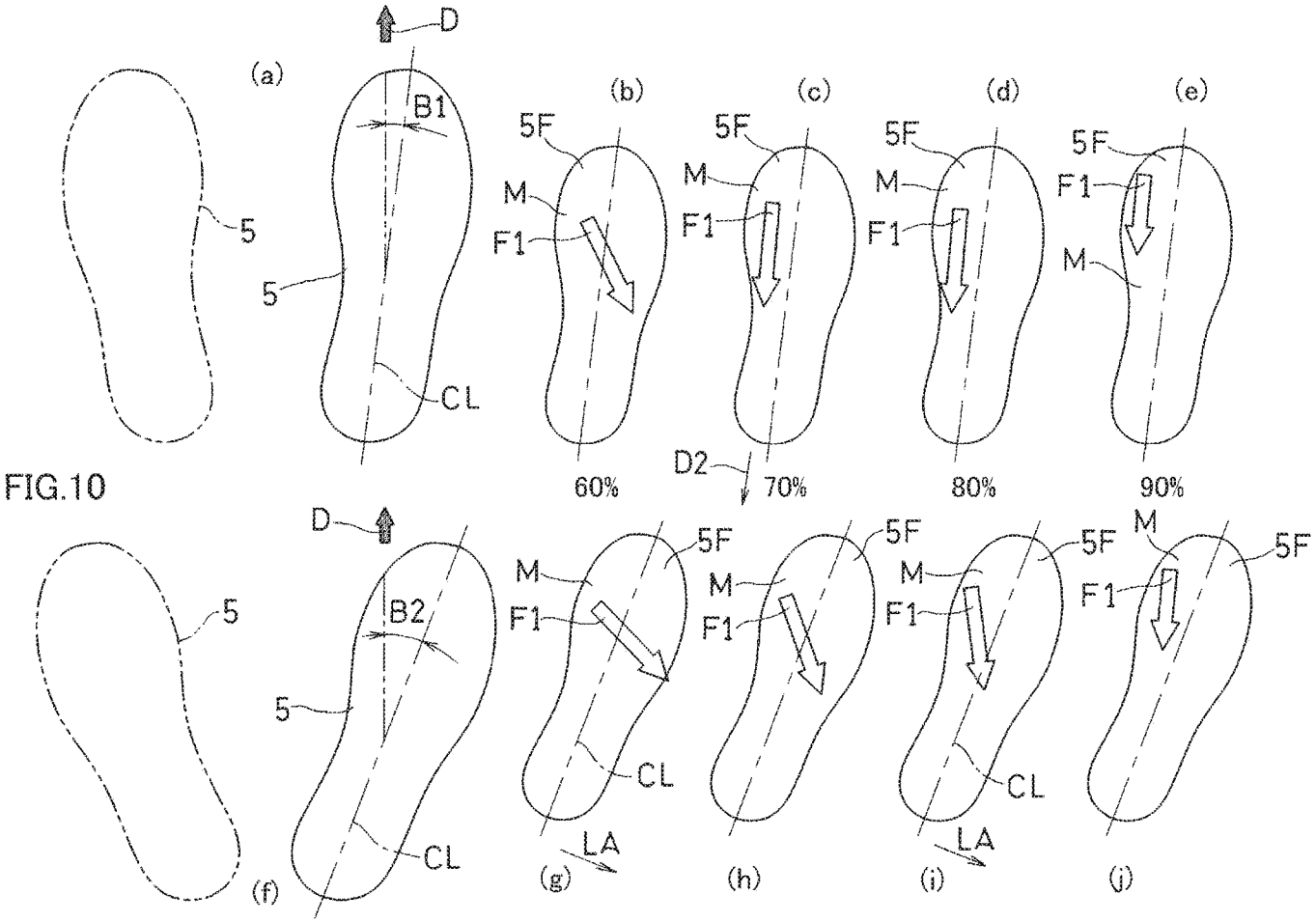
FIG. 10 is a conceptual diagram showing the primary load occurring when running uphill.
Figure 11:
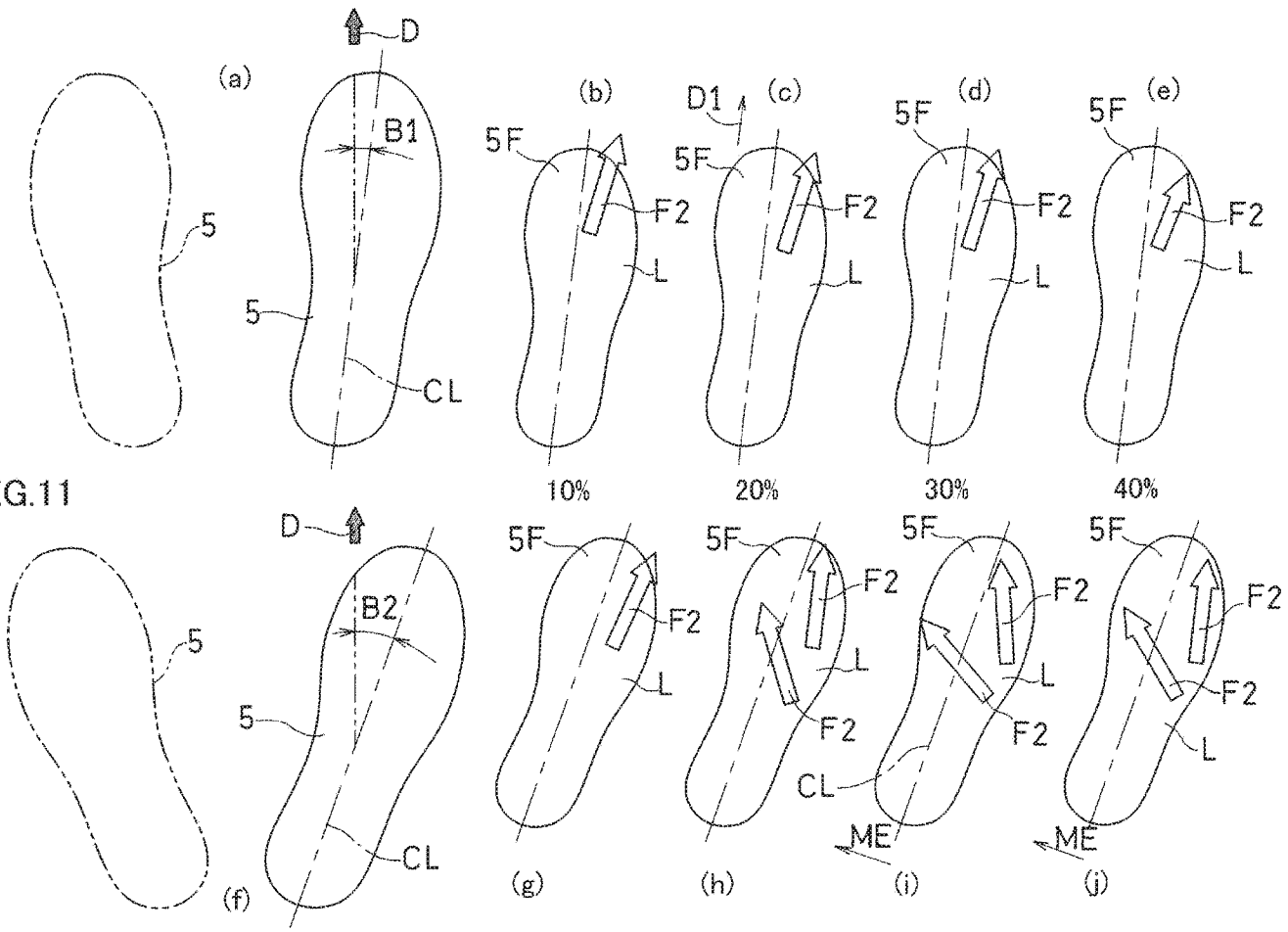
FIG. 11 is a conceptual diagram showing the primary load occurring when running downhill.

FIG. 9 shows Embodiment 3.

In the forefoot portion 5F shown in this figure, the first engaging surfaces 11E of the medial cleats 11 each have both a surface E1 facing toward the posterior D2 direction and a surface E2 facing toward an obliquely posterior direction. On the other hand, the second engaging surfaces 14E of the lateral cleats 14 may each have both a surface E3 facing toward an anterior D1 direction and a surface E4 facing toward an obliquely anterior direction.

The normal lines NL1 and NL3 orthogonal to the surfaces E1 and E3 facing toward the posterior D2 direction or the anterior D1 direction are parallel to the longitudinal axis CL. The normal line NL2 orthogonal to the surface E2 facing toward the obliquely posterior direction intersects with the longitudinal axis CL at a point O2 that is posterior to the surface E2. On the other hand, the normal line NL4 orthogonal to the surface E4 facing toward the obliquely anterior direction intersects with the longitudinal axis CL at a point O4 that is anterior to the surface E4.

Figure 13A:
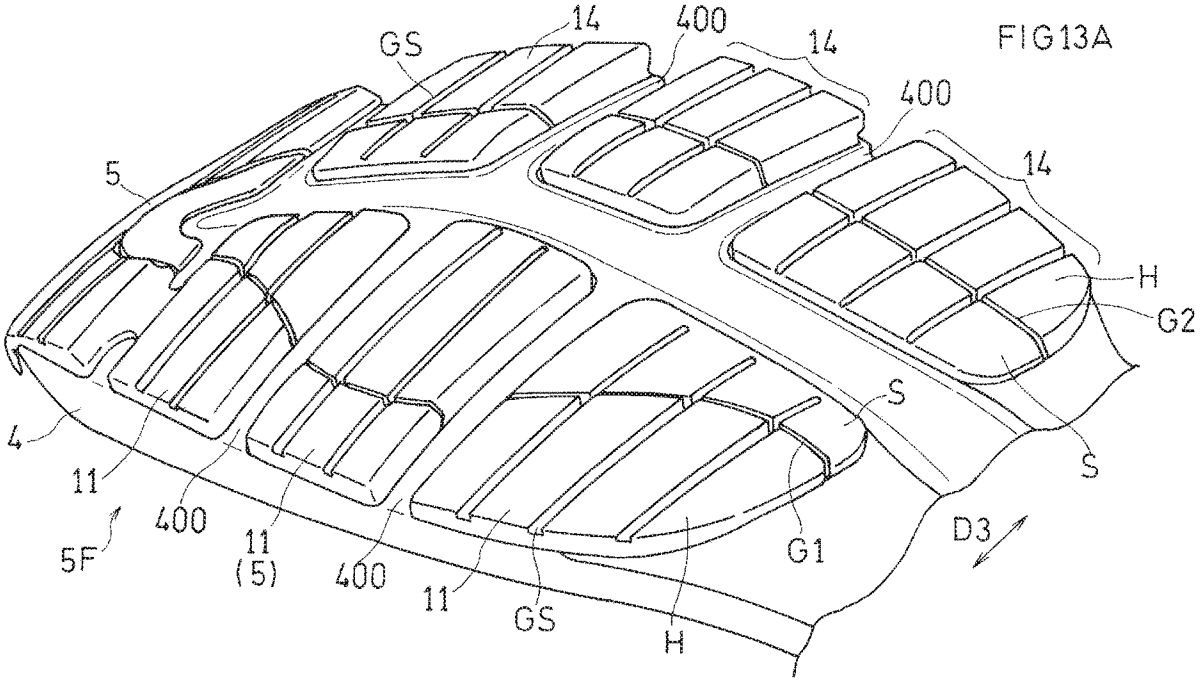
FIG. 13A is a perspective view showing the forefoot portion of a shoe sole of Embodiment 4.
Figure 13B:
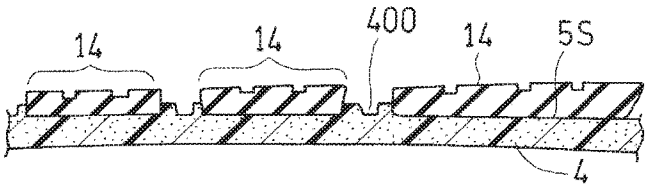
FIG. 13B is a schematic cross-sectional view of the same embodiment.

FIG. 13A and FIG. 13B show Embodiment 4.

As shown in FIG. 13A, in the case of the present embodiment, the cleats 11, 14 are separated from, and spaced apart from, each other in the front-rear direction and in the width direction D3. That is, the medial cleats 11 are spaced apart from each other, and the lateral cleats 14 are spaced apart from each other, in the front-rear direction with exposed surfaces 400 of the midsole 4 interposed therebetween. The medial cleats 11 and the lateral cleats 14 are spaced apart from each other in the width direction D3 with the exposed surfaces 400 of the midsole 4 interposed therebetween.

When the cleats 11, 14 are independent of each other as shown in FIG. 13A and FIG. 13B so that the base surface 5S does not appear to exist on the outsole 5, the surface on which the outsole 5 of the cleats 11, 14 are attached defines the base surface 5S. The reason for this is that the thickness of the outsole 5 from this surface is the height of the cleats 11, 14.

Note that in the case of this example, in terms of the function as a single cleat discussed above, the single cleat 11, 14 is the area surrounded by the midsole 4.

While preferred embodiments have been described above with reference to the drawings, various obvious changes and modifications will readily occur to those skilled in the art upon reading the present specification.

For example, the grooves G, G1, G2, G3 do not need to be provided. A reinforcement device may be provided, instead of the outsole, in the midfoot portion.

Thus, such changes and modifications are deemed to fall within the scope of the present invention, which is defined by the appended claims.

INDUSTRIAL APPLICABILITY

The present invention is applicable to shoe soles for walking shoes, rain shoes and shoes for daily use, as well as soles for trail running, mountain climbing and cross country.

DESCRIPTION OF REFERENCE SIGNS

1F: Forefoot, 1M: Midfoot, 1R: Rearfoot

4: Midsole, 5: Outsole

5F: Forefoot portion, 5M: Midfoot portion, 5R: Rearfoot portion, 5S: Base surface

50: Outer peripheral edge, 51: Projecting portion, 52: Line of intersection, 53: Projecting end, 54: Non-projecting end

11: Medial (first) cleat, 14: Lateral (first) cleat

11E: First engaging surface, 14E: Second engaging surface, E1 to E4: Surface

15, 25, 35: Auxiliary cleat

21: Medial second cleat, 24: Lateral second cleat, 21E, 24E: Engaging surface

31: Medial third cleat, 34: Lateral third cleat, 31E, 34E: Engaging surface AH: Hard area, AS: Soft area H: Near-edge portion, S: Near-center portion, T: Tip portion, CR: Rear end portion CN: Central portion, M: Medial portion, L: Lateral portion CL: Longitudinal axis, D1: Anterior, D2: Posterior, D3: Width direction LE, L1, L2: Length NL1 to NL4: Normal line, O2, O4: Point F1, F2: Arrow G: (Deep) groove, G1, G2: Partitioning groove, GS: Groove Hp: Height of projection, A: Length of projection S1: First opposing surface, S2: Second opposing surface, S3: Side engaging surface, TS: Top surface (tread surface)

S11, S31: Medial side surface, S14, S34: Lateral side surface

ME: Medial side, LA: Lateral side $\alpha$1, $\alpha$2, $\beta$1, $\beta$2: Angle, $\theta$1, $\theta$2, $\theta$3: Angle, B1, B2: Open angle

The invention claimed is:

1. A shoe sole comprising a rubber-made outsole, and a resin-made midsole, wherein:

a forefoot portion of the outsole includes a medial portion, a lateral portion, and a central portion between the medial portion and the lateral portion;

a plurality of rubber-made medial cleats projecting from a base surface of the outsole or the midsole are provided in the medial portion of the forefoot portion;

a plurality of rubber-made lateral cleats projecting from the base surface of the outsole or the midsole are provided in the lateral portion of the forefoot portion;

the medial cleats and the lateral cleats are spaced apart from each other in a width direction perpendicular to a longitudinal axis of the outsole;

the medial cleats each include a first engaging surface, and a first opposing surface on an opposite side from the first engaging surface;

the lateral cleats each include a second engaging surface, and a second opposing surface on an opposite side from the second engaging surface;

the first engaging surface satisfies a requirement (c1) below with respect to the first opposing surface:

(c1) a projection length by which each of the medial cleats projects in the width direction from an outer peripheral edge of the base surface is greater in the first engaging surface than in the first opposing surface; and the second engaging surface satisfies a requirement (c2) below with respect to the second opposing surface:

(c2) a projection length by which each of the lateral cleats projects in the width direction from the outer peripheral edge of the base surface is greater in the second engaging surface than in the second opposing surface, and wherein:

the first engaging surface of each of the medial cleats faces toward a posterior direction or an obliquely posterior direction; and the second engaging surface of each of the lateral cleats faces toward an anterior direction or an obliquely anterior direction.

2. The shoe sole according to claim 1, wherein following requirements (a1), (b1), (a2) and (b2) are satisfied;

(a1) a length of the first engaging surface in the width direction is greater than a length of the first opposing surface in the width direction;

(b1) an angle of the first engaging surface with respect to the base surface is closer to 90° than an angle of the first opposing surface with respect to the base surface;

(a2) a length of the second engaging surface in the width direction is greater than a length of the second opposing surface in the width direction; and (b2) an angle of the second engaging surface with respect to the base surface is closer to 90° than an angle of the second opposing surface with respect to the base surface.

3. The shoe sole according to claim 1, wherein each of the medial cleats and the lateral cleats further includes a side engaging surface extending, in a front-rear direction along the longitudinal axis or in an obliquely front-rear direction, toward the central portion.

4. The shoe sole according to claim 1, wherein the first engaging surface of each of the medial cleats includes a surface facing toward an obliquely posterior and lateral direction, and the second engaging surface of each of the lateral cleats includes a surface facing toward an obliquely anterior and medial direction.

5. The shoe sole according to claim 1, further comprising one or more auxiliary cleats between the medial cleats and the lateral cleats at one or more positions that are spaced apart from the medial cleats and the lateral cleats.

6. A shoe sole comprising a rubber-made outsole, and a resin-made midsole, wherein:

a forefoot portion of the outsole includes a medial portion, a lateral portion, and a central portion between the medial portion and the lateral portion;

a plurality of rubber-made medial cleats projecting from a base surface of the outsole or the midsole are provided in the medial portion of the forefoot portion;

a plurality of rubber-made lateral cleats projecting from the base surface of the outsole or the midsole are provided in the lateral portion of the forefoot portion;

the medial cleats and the lateral cleats are spaced apart from each other in a width direction perpendicular to a longitudinal axis of the outsole;

the medial cleats each include a first engaging surface, and a first opposing surface on an opposite side from the first engaging surface;

the lateral cleats each include a second engaging surface, and a second opposing surface on an opposite side from the second engaging surface;

the first engaging surface satisfies at least one of requirements (a1) to (c1) below with respect to the first opposing surface:

(a1) a length of the first engaging surface in the width direction is greater than a length of the first opposing surface in the width direction;

(b1) an angle of the first engaging surface with respect to the base surface is closer to 90° than an angle of the first opposing surface with respect to the base surface;

(c1) a projection length by which each of the medial cleats projects in the width direction from an outer peripheral edge of the base surface is greater in the first engaging surface than in the first opposing surface; and the second engaging surface satisfies at least one of requirements (a2) to (c2) below with respect to the second opposing surface:

(a2) a length of the second engaging surface in the width direction is greater than a length of the second opposing surface in the width direction;

(b2) an angle of the second engaging surface with respect to the base surface is closer to 90° than an angle of the second opposing surface with respect to the base surface;

(c2) a projection length by which each of the lateral cleats projects in the width direction from the outer peripheral edge of the base surface is greater in the second engaging surface than in the second opposing surface, and wherein:

the first engaging surface of each of the medial cleats faces toward a posterior direction or an obliquely posterior direction;

the second engaging surface of each of the lateral cleats faces toward an anterior direction or an obliquely anterior direction;

the first engaging surface projects in the width direction from the outer peripheral edge of the base surface;

the first opposing surface is placed in a non-projecting manner within an area of the base surface that is surrounded by the outer peripheral edge;

the second engaging surface projects in the width direction from the outer peripheral edge of the base surface; and the second opposing surface is placed in a non-projecting manner within an area of the base surface that is surrounded by the outer peripheral edge.

7. A shoe sole comprising a rubber-made outsole, and a resin-made midsole, wherein:

a forefoot portion of the outsole includes a medial portion, a lateral portion, and a central portion between the medial portion and the lateral portion;

a plurality of rubber-made medial cleats projecting from a base surface of the outsole or the midsole are provided in the medial portion of the forefoot portion;

a plurality of rubber-made lateral cleats projecting from the base surface of the outsole or the midsole are provided in the lateral portion of the forefoot portion;

the medial cleats and the lateral cleats are spaced apart from each other in a width direction perpendicular to a longitudinal axis of the outsole;

the medial cleats each include a first engaging surface, and a first opposing surface on an opposite side from the first engaging surface;

the lateral cleats each include a second engaging surface, and a second opposing surface on an opposite side from the second engaging surface;

the first engaging surface satisfies at least one of requirements (a1) to (c1) below with respect to the first opposing surface:

(a1) a length of the first engaging surface in the width direction is greater than a length of the first opposing surface in the width direction;

(b1) an angle of the first engaging surface with respect to the base surface is closer to 90° than an angle of the first opposing surface with respect to the base surface;

(c1) a projection length by which each of the medial cleats projects in the width direction from an outer peripheral edge of the base surface is greater in the first engaging surface than in the first opposing surface; and the second engaging surface satisfies at least one of requirements (a2) to (c2) below with respect to the second opposing surface:

(a2) a length of the second engaging surface in the width direction is greater than a length of the second opposing surface in the width direction;

(b2) an angle of the second engaging surface with respect to the base surface is closer to 90° than an angle of the second opposing surface with respect to the base surface;

(c2) a projection length by which each of the lateral cleats projects in the width direction from the outer peripheral edge of the base surface is greater in the second engaging surface than in the second opposing surface, and wherein:

the first engaging surface of each of the medial cleats faces toward a posterior direction or an obliquely posterior direction;

the second engaging surface of each of the lateral cleats faces toward an anterior direction or an obliquely anterior direction; and an upper end of the first and/or second engaging surface is placed within an area of the base surface that is surrounded by the outer peripheral edge, and a most near-edge projecting end of the medial and/or lateral cleats on a line of intersection between a tread surface of the medial and/or lateral cleats to be in contact with a road surface and the first and/or second engaging surface is projecting in the width direction from the outer peripheral edge.

8. A shoe sole comprising a rubber-made outsole, and a resin-made midsole, wherein:

the outsole includes a medial portion, a lateral portion, and a central portion between the medial portion and the lateral portion;

a plurality of rubber-made medial cleats projecting from a base surface of the outsole or the midsole are provided in the medial portion;

a plurality of rubber-made lateral cleats projecting from the base surface of the outsole or the midsole are provided in the lateral portion;

the medial cleats and the lateral cleats are spaced apart from each other in a width direction perpendicular to the longitudinal axis of the outsole;

at least one cleat of the medial cleats and the lateral cleats includes a near-edge portion which is placed near a medial edge or a lateral edge of the outsole, and a near-center portion which is placed near the central portion of the outsole;

the near-edge portion and the near-center portion each include a tread surface;

the near-edge portion and the near-center portion are placed with respect to each other with a groove having a width of 3 mm or less therebetween, or are continuous with each other in the width direction; and a value of compressive stiffness of the near-center portion is smaller than a value of compressive stiffness of the near-edge portion, or a value of rubber hardness of the near-center portion is smaller than a value of rubber hardness of the near-edge portion.

9. The shoe sole according to claim 8, wherein at least the value of rubber hardness of the near-center portion is smaller than the value of rubber hardness of the near-edge portion.

10. The shoe sole according to claim 8, wherein:

those of the medial cleats that are arranged in a front-rear direction each include the near-edge portion and the near-center portion; and those of the lateral cleats that are arranged in the front-rear direction each include the near-edge portion and the near-center portion.

11. The shoe sole according to claim 10, wherein the medial cleats arranged in the front-rear direction and the lateral cleats arranged in the front-rear direction are placed in the forefoot portion of the outsole.

12. The shoe sole according to claim 11, wherein a value of compressive stiffness and/or rubber hardness of a soft area of the outsole from the near-center portion of the medial cleats to the near-center portion of the lateral cleats in the forefoot portion is smaller than a value of compressive stiffness and/or rubber hardness of the near-edge portion of the medial and lateral cleats in the forefoot portion.

13. The shoe sole according to claim 12, wherein a hard area having a greater compressive stiffness and/or rubber hardness than that of the soft area is provided in the medial portion, the lateral portion and a tip portion of the forefoot portion.

14. The shoe sole according to claim 13, wherein another groove is formed on the outsole between the soft area and the hard area, the groove being continuous with the groove.

15. The shoe sole according to claim 10, wherein those of the medial cleats that are arranged in the front-rear direction and those of the lateral cleats that are arranged in the front-rear direction are placed in a rearfoot portion of the outsole.

16. The shoe sole according to claim 15, wherein a value of compressive stiffness and/or rubber hardness of a soft area of the outsole from the near-center portion of the medial cleats to the near-center portion of the lateral cleats in the rearfoot portion is smaller than a value of compressive stiffness and/or rubber hardness of the near-edge portion of the medial and lateral cleats in the rearfoot portion.

17. The shoe sole according to claim 16, wherein a hard area having a greater value of compressive stiffness and/or rubber hardness than that of the soft area is provided in the medial portion, the lateral portion and a rear end portion of the rearfoot portion.

18. The shoe sole according to claim 8, wherein the groove extends from the tread surface to the base surface.

19. The shoe sole according to claim 8, wherein each of the medial cleats and the lateral cleats includes an engaging surface, and an opposing surface on an opposite side from the engaging surface, and the engaging surface of each cleat includes a projecting portion projecting in the width direction from an outer peripheral edge of the base surface.

20. The shoe sole according to claim 19, wherein an upper end of the engaging surface is arranged within an area of the base surface that is surrounded by the outer peripheral edge, and the projecting portion includes a most near-edge projecting end which is a nearest-to-edge portion of the projecting portion on a line of intersection between a tread surface to be in contact with a road surface and the engaging surface, the projecting end projecting in the width direction from the outer peripheral edge.

* * * * *